US009644554B2

(12) United States Patent
Iwase et al.

(10) Patent No.: US 9,644,554 B2
(45) Date of Patent: May 9, 2017

(54) CYLINDER-BY-CYLINDER AIR-FUEL-RATIO CONTROLLER FOR INTERNAL COMBUSTION ENGINE

(71) Applicant: DENSO CORPORATION, Kariya, Aichi-pref. (JP)

(72) Inventors: Noriaki Iwase, Obu (JP); Yasuo Mukai, Kariya (JP)

(73) Assignee: DENSO CORPORATION, Kariya (JP)

( * ) Notice: Subject to any disclaimer, the term of this patent is extended or adjusted under 35 U.S.C. 154(b) by 443 days.

(21) Appl. No.: 14/463,281

(22) Filed: Aug. 19, 2014

(65) Prior Publication Data

US 2015/0068505 A1 Mar. 12, 2015

(30) Foreign Application Priority Data

Sep. 9, 2013 (JP) ..... 2013-185986

(51) Int. Cl.

*F02D 41/00* (2006.01)
*F02D 41/14* (2006.01)
*F02D 41/24* (2006.01)

(52) U.S. Cl.

CPC ..... *F02D 41/008* (2013.01); *F02D 41/1456* (2013.01); *F02D 41/1458* (2013.01); *F02D 41/2451* (2013.01); *F02D 41/2454* (2013.01); *F02D 2250/14* (2013.01)

(58) Field of Classification Search

CPC ..... F02D 35/0015; F02D 41/008; F02D 41/0085; F02D 41/06; F02D 41/061; F02D 41/1403; F02D 41/1438; F02D 41/1439; F02D 41/1454; F02D 41/1488; F02D 41/1486

See application file for complete search history.

(56) References Cited

U.S. PATENT DOCUMENTS 5,806,506 A * 9/1998 Kitamura ..... F02D 41/008 123/673
5,947,096 A * 9/1999 Kurokawa ..... F02D 41/008 123/673
7,063,080 B2 6/2006 Kita et al.
(Continued)

OTHER PUBLICATIONS

Iwase, et al., U.S. Appl. No. 14/463,188, filed Aug. 19, 2014.

*Primary Examiner* — Erick Solis
*Assistant Examiner* — Anthony L Bacon
(74) *Attorney, Agent, or Firm* — Nixon & Vanderhye P.C.

(57) ABSTRACT

An air-fuel-ratio of each cylinder is estimated based on a detection value of an air-fuel-ratio sensor. An air-fuel-ratio detection timing determination is executed to determine whether a deviation in air-fuel-ratio detection timing exists based on the estimated air-fuel-ratio while the cylinder-by-cylinder air-fuel-ratio control is performed. An observation residual is computed based on the detection value of the air-fuel-ratio sensor and the estimated air-fuel-ratio. When the observation residual is greater than or equal to a specified threshold value, the air-fuel-ratio detection timing determination is prohibited. Therefore, when the observation residual is still large before the estimated air-fuel-ratio of each cylinder is converged, or when the observation residual is still large due to a temporal deterioration in estimating accuracy of the estimated air-fuel-ratio, the air-fuel-ratio detection timing determination can be prohibited.

9 Claims, 13 Drawing Sheets

(56) References Cited

U.S. PATENT DOCUMENTS

| | | | | |
|---|---|---|---|---|
| 9,482,171 | B2 * | 11/2016 | Iwase | F02D 41/0085 |
| 2005/0121010 | A1 | 6/2005 | Kita et al. | |
| 2006/0236990 | A1 * | 10/2006 | Annoura | F02D 41/008 123/673 |
| 2007/0240695 | A1 * | 10/2007 | Mitsuda | F02D 13/06 123/673 |
| 2008/0040018 | A1 * | 2/2008 | Katoch | F02D 13/0215 701/103 |
| 2008/0114526 | A1 * | 5/2008 | Nozawa | F02D 41/22 701/103 |
| 2009/0164090 | A1 * | 6/2009 | Yasui | F02D 41/1403 701/102 |
| 2012/0255532 | A1 * | 10/2012 | Kawakatsu | F02D 41/0085 123/673 |
| 2013/0304356 | A1 | 11/2013 | Kawakatsu et al. | |

* cited by examiner

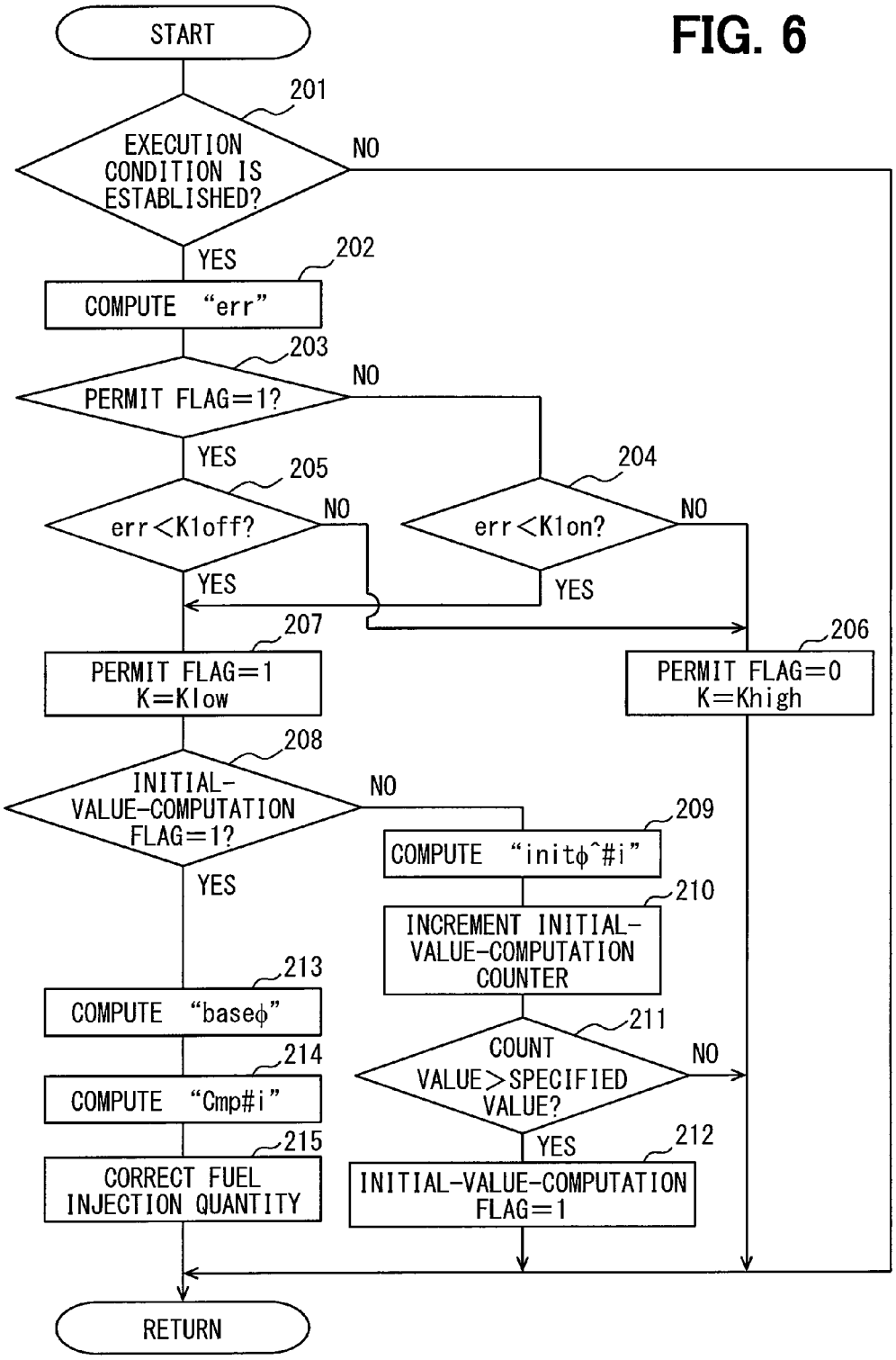
FIG. 6
START
201
EXECUTION CONDITION IS ESTABLISHED?
NO
YES
202
COMPUTE "err"
203
PERMIT FLAG=1?
NO
YES
205
err<K1off?
NO
YES
204
err<K1on?
NO
YES
207
PERMIT FLAG=1
K=Klow
206
PERMIT FLAG=0
K=Khigh
208
INITIAL-VALUE-COMPUTATION FLAG=1?
NO
YES
209
COMPUTE "initϕ^#i"
210
INCREMENT INITIAL-VALUE-COMPUTATION COUNTER
211
COUNT VALUE>SPECIFIED VALUE?
NO
YES
212
INITIAL-VALUE-COMPUTATION FLAG=1
213
COMPUTE "baseϕ"
214
COMPUTE "Cmp#i"
215
CORRECT FUEL INJECTION QUANTITY
RETURN START
301
EXECUTION CONDITION IS ESTABLISHED?
NO
YES
302
COMPUTE "err"
303
PERMIT FLAG=1?
NO
YES
305
err<K2off?
NO
YES
304
err<K2on?
NO
YES
307
PERMIT FLAG=1
306
PERMIT FLAG=0
308
|Cmp#i|>KC?
NO
YES
309
ϕ^#i-initϕ^#i / Cmp#i < DEVIATION DETERMINATION VALUE?
NO
YES
310
AIR-FUEL-RATIO DETECTION TIMING DEVIATES
DEVIATION-DETERMINATION FLAG=1
RETURN (※COMBUSTION ORDER: #1→#3→#4→#2)

| | | (a) CURRENT TIMING+0 CA | (b) CURRENT TIMING+180 CA | (c) CURRENT TIMING+360 CA | (d) CURRENT TIMING+540 CA |
|---|---|---|---|---|---|
| ESTIMATED AIR-FUEL-RATIO | φ^#1 | #1 | #2 | #4 | #3 |
| | φ^#3 | #3 | #1 | #2 | #4 |
| | φ^#4 | #4 | #3 | #1 | #2 |
| | φ^#2 | #2 | #4 | #3 | #1 |

CYLINDER-BY-CYLINDER AIR-FUEL-RATIO CONTROLLER FOR INTERNAL COMBUSTION ENGINE

CROSS-REFERENCE TO RELATED APPLICATION

This application is based on Japanese Patent Application No. 2013-185986 filed on Sep. 9, 2013, the disclosure of which is incorporated herein by reference.

TECHNICAL FIELD

The present disclosure relates to a cylinder-by-cylinder air-fuel-ratio controller that can estimate an air-fuel-ratio of each cylinder based on a detection value of an air-fuel-ratio sensor disposed in a confluent portion of an exhaust gas emitted from an internal combustion engine.

BACKGROUND

Japanese Patent No. 4321411 (U.S. Pat. No. 7,063,080 B2) shows a system that performs a cylinder-by-cylinder air-fuel-ratio control. In the cylinder-by-cylinder air-fuel-ratio control, an air-fuel-ratio of each cylinder of an internal combustion engine is estimated based on a detection value of an air-fuel-ratio sensor. The air-fuel-ratio sensor detects the air-fuel-ratio at a specific timing for each cylinder. Based on the estimated air-fuel-ratio of each cylinder, the actual air-fuel-ratio of each cylinder is controlled. During an engine driving, a deviation in air-fuel-ratio detection timing is detected and the controller corrects the detection timing.

Specifically, it is determined whether the air-fuel-ratio detection timing deviates from a proper timing based on whether the variation of the estimated air-fuel-ratio between cylinders is large or whether increase-and-decrease directions of the fuel correction quantity and the estimated air-fuel-ratio are opposite to each other. When it is determined that the air-fuel-ratio detection timing deviates between cylinders, the air-fuel-ratio detection timing of each cylinder is corrected based on a relationship between a variation in estimated air-fuel-ratio of at least one cylinder and a variation in its corrected amount of fuel.

However, in the above cylinder-by-cylinder air-fuel-ratio control, when the increase-and-decrease direction of the fuel correction quantity and the estimated air-fuel-ratio becomes temporarily opposite to each other before the estimated air-fuel-ratio is converged, or when an estimation accuracy of the estimated air-fuel-ratio temporarily becomes deteriorated, it may be determined that the air-fuel-ratio detection timing deviates from a proper timing even though the air-fuel-ratio detection timing does not deviate.

SUMMARY

It is an object of the present disclosure to provide a cylinder-by-cylinder air-fuel-ratio controller that can improve a detection accuracy of deviation in air-fuel-ratio detection timing in a system where an air-fuel-ratio of each cylinder is estimated based on a detection value of an air-fuel-ratio sensor disposed in a confluent portion of an exhaust gas emitted from an internal combustion engine.

According to the present disclosure, a cylinder-by-cylinder air-fuel-ratio controller includes an air-fuel-ratio sensor detecting an air-fuel-ratio of an exhaust gas at a confluent portion into which the exhaust gas flows from each of multiple cylinders of the internal combustion engine; an estimation portion estimating the air-fuel-ratio of each cylinder based on a detection value which the air-fuel-ratio sensor detects at an air-fuel-ratio detection timing for each cylinder; and a control portion executing a cylinder-by-cylinder air-fuel-ratio control in which the air-fuel-ratio of each cylinder is controlled based on the estimated air-fuel-ratio of each cylinder.

Further, the cylinder-by-cylinder air-fuel-ratio controller includes: a determining portion determining whether a deviation in the air-fuel-ratio detection timing exists based on the estimated air-fuel-ratio while the cylinder-by-cylinder air-fuel-ratio control is executed; a correcting portion correcting the air-fuel-ratio detection timing when the determining portion determines that the deviation in the air-fuel-ratio detection timing exists; a residual computing portion computing an observation residual based on the detection value of the air-fuel-ratio sensor and the estimated air-fuel-ratio; and a determination prohibiting portion prohibiting the determining portion from determining whether the deviation in the air-fuel-ratio detection timing exists when the observation residual is greater than or equal to a specified threshold value.

According to the present embodiment, the ECU 39 computes an observation residual based on the detected value of the air-fuel-ratio sensor 36 (actual air-fuel-ratio) and the estimated air-fuel-ratio. When the observation residual is greater than or equal to a specified threshold value, the ECU 39 prohibits the air-fuel-ratio detection timing determination. Therefore, when the observation residual is still large before the estimated air-fuel-ratio of each cylinder is converged, or when the observation residual is still large due to a temporal deterioration in estimating accuracy of the estimated air-fuel-ratio, the air-fuel-ratio detection timing determination can be prohibited. Thus, it can be avoided determining that the air-fuel-ratio detection timing deviates from a proper timing even though the air-fuel-ratio detection timing does not deviate. The determination accuracy of the deviation of the air-fuel-ratio detection timing can be improved.

BRIEF DESCRIPTION OF THE DRAWINGS

The above and other objects, features and advantages of the present disclosure will become more apparent from the following detailed description made with reference to the accompanying drawings. In the drawings:

FIG. 6 is a flow chart showing a processing of a cylinder-by-cylinder air-fuel-ratio control routine;

DETAILED DESCRIPTION

Figure 1:
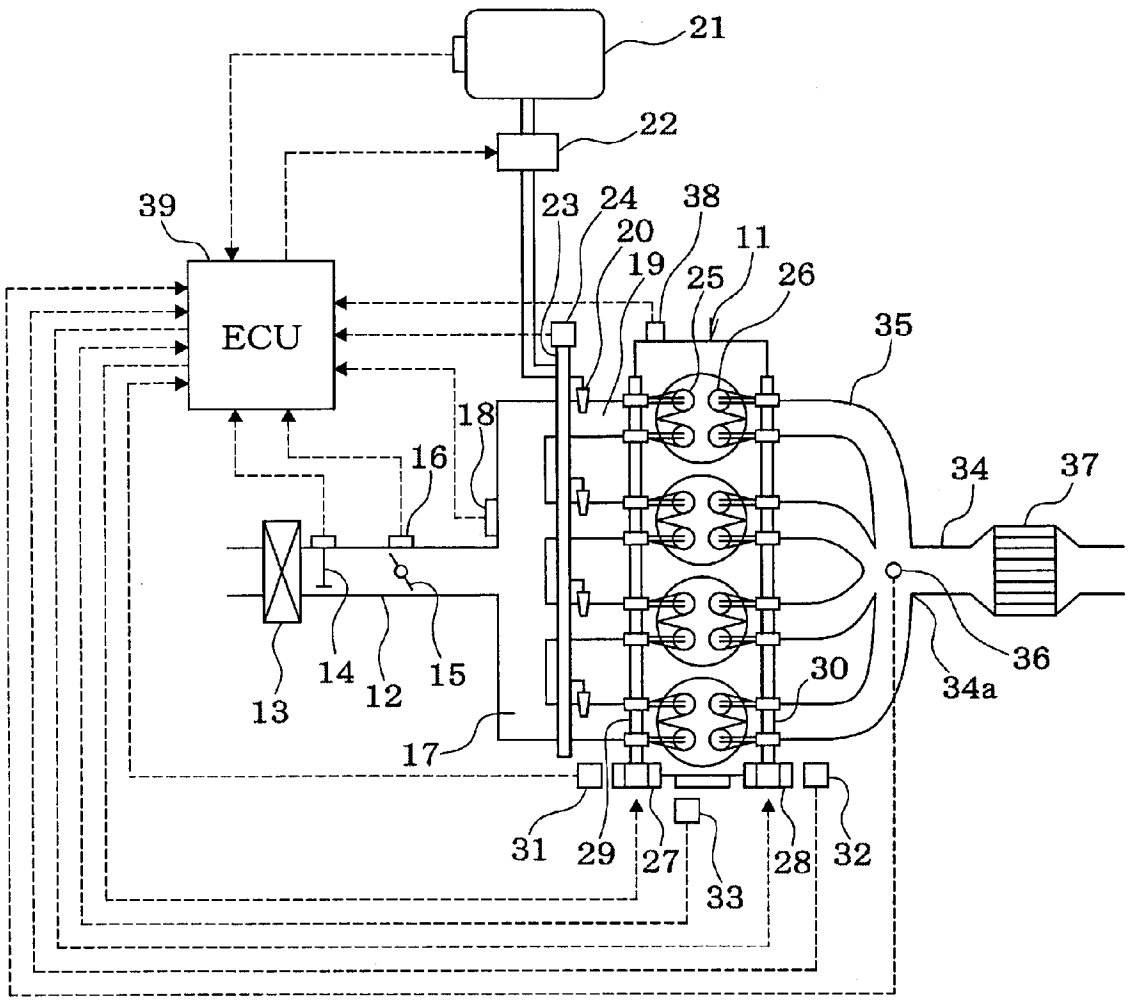
FIG. 1 is a schematic view of an engine control system according to an embodiment.

An embodiment will be described hereinafter. First, referring to FIG. 1, an engine control system is explained. A four-cylinder engine 11 has a first cylinder #1, a second cylinder #2, a third cylinder #3 and a fourth cylinder #4. An air cleaner 13 is arranged upstream of an intake pipe 12 of an internal combustion engine 11. An airflow meter 14 detecting an intake air flow rate is provided downstream of the air cleaner 13. A throttle valve 15 driven by a DC-motor and a throttle position sensor 16 detecting a throttle position are provided downstream of the air flow meter 14.

A surge tank 17 including an intake air pressure sensor 18 is provided downstream of the throttle valve 15. The intake air pressure sensor 18 detects intake air pressure. An intake manifold 19 that introduces air into each cylinder of the engine 11 is provided downstream of the surge tank 17, and the fuel injector 20 that injects the fuel is provided at a vicinity of an intake port of the intake manifold 19 of each cylinder. While the engine 11 is running, the fuel in the fuel tank 21 is supplied to a delivery pipe 23 by a fuel pump 22. The fuel injector 20 provided to each cylinder injects the fuel into a cylinder. A fuel pressure sensor 24 detecting a fuel pressure is attached to the delivery pipe 23.

The engine 11 is provided with variable valve timing controllers 27, 28 that respectively adjust a valve timing of an intake valve 25 and an exhaust valve 26. Furthermore, the engine 11 is provided with an intake-cam-angle sensor 31 and an exhaust-cam-angle sensor 32. A crank angle sensor 33 is arranged for detecting a rotational angle of a crankshaft. The crank angle sensor 33 outputs a crank angle signal when the crankshaft rotates 30° CA, for example.

At a confluent portion 34*a* of an exhaust manifold 35, an air-fuel-ratio sensor 36 that detects the air-fuel-ratio of the exhaust gas is provided. A three-way catalyst 37 that purifies the exhaust gas is provided downstream of the air-fuel-ratio sensor 36. A coolant temperature sensor 38 detecting coolant temperature is fixed on the cylinder block of the engine 11.

The outputs of the above sensors are transmitted to an electronic control unit (ECU) 39. The ECU 39 includes a microcomputer that executes an engine control program stored in a Read Only Memory (ROM) to control a fuel injection quantity, an ignition timing, a throttle position (intake air flow rate) and the like.

When an air-fuel-ratio feedback control execution condition is established, the ECU 39 executes an air-fuel-ratio feedback control in which the air-fuel-ratio of the air-fuel mixture is controlled based on the output of the air-fuel-ratio sensor 36 so that the air-fuel-ratio of the exhaust gas agrees with the target air-fuel-ratio.

Figure 2:
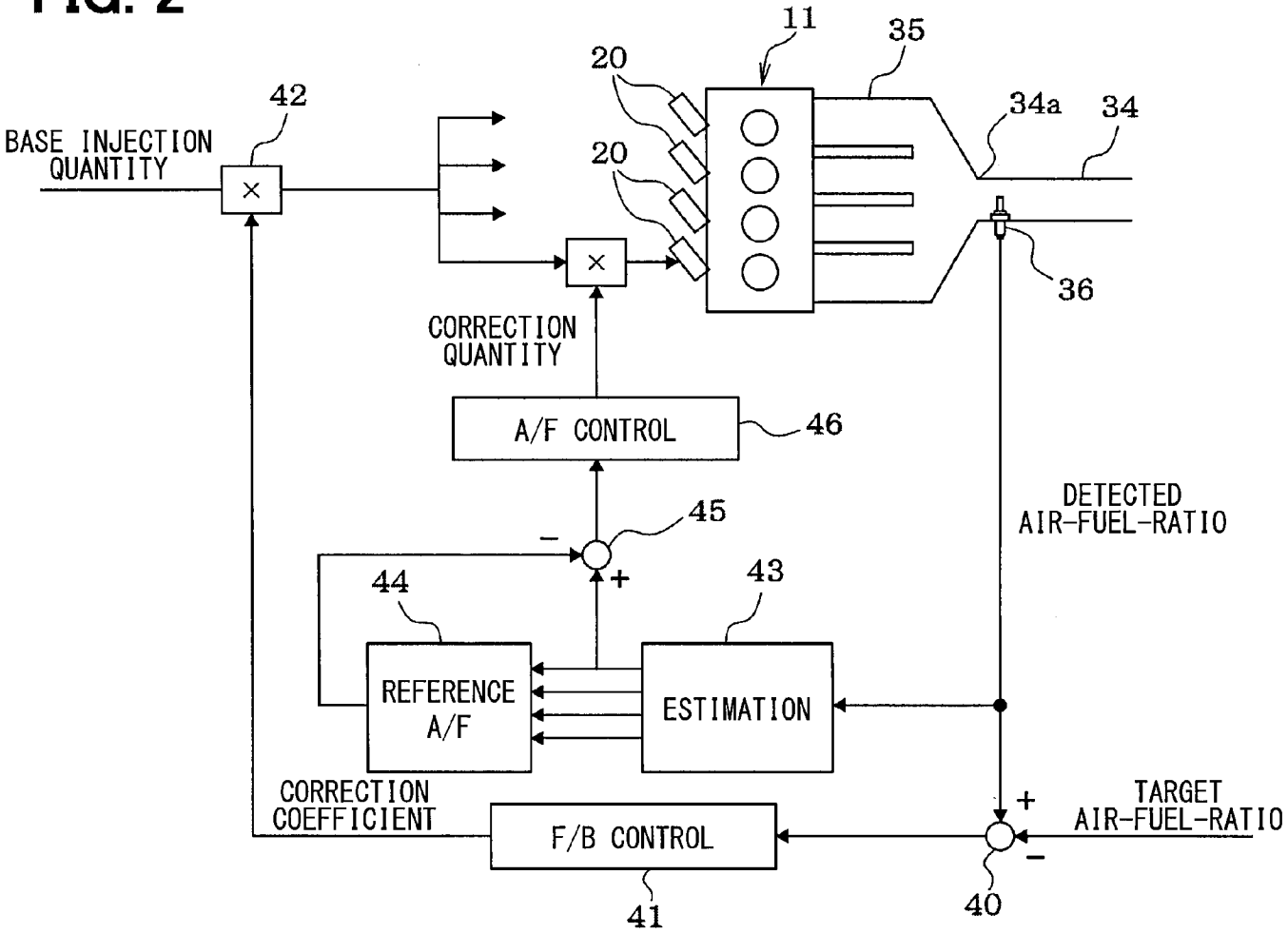
FIG. 2 is a block diagram for explaining an air-fuel-ratio control.

Specifically, as shown in FIG. 2, a difference computing portion 40 computes a difference between the detected air-fuel-ratio (air-fuel-ratio of exhaust gas detected by the air-fuel-ratio sensor 36) and the target air-fuel-ratio. An air-fuel-ratio control portion 41 computes a correction coefficient in order to reduce the difference. An injection-quantity computing portion 42 computes a fuel injection quantity based on a base quantity and the correction coefficient, which are computed based on an engine speed and an engine load. Each of fuel injectors 20 injects the fuel of the computed injection quantity.

Figure 5:
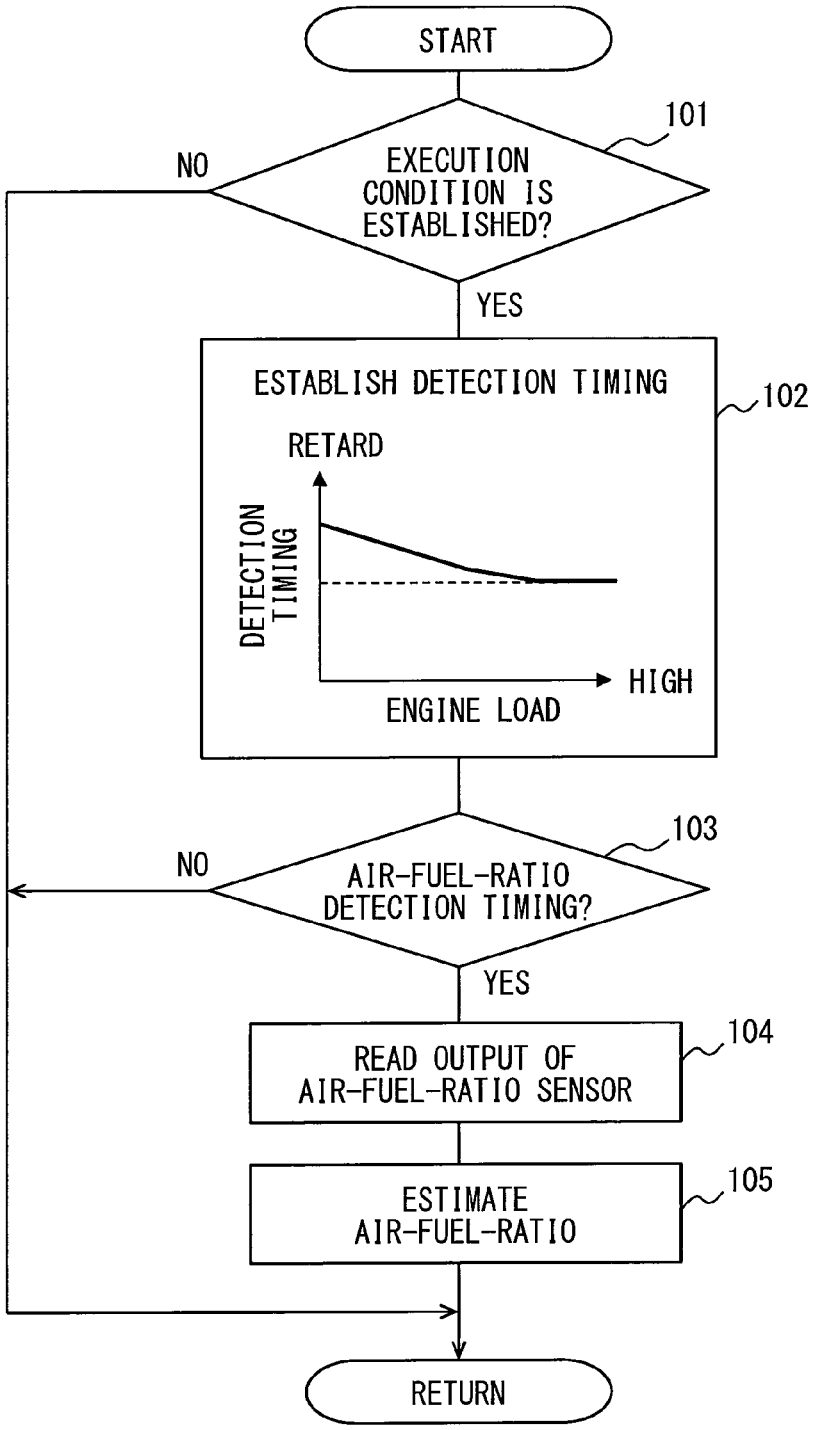
FIG. 5 is a flow chart showing a processing of a cylinder-by-cylinder air-fuel-ratio estimation routine.

Furthermore, the ECU 39 executes a cylinder-by-cylinder air-fuel-ratio estimation shown in FIGS. 5 and 6, whereby the air-fuel-ratio of each cylinder is estimated based on a detection value of an air-fuel-ratio sensor 36. The air-fuel-ratio sensor 36 detects the air-fuel-ratio of each cylinder at an air-fuel-ratio detection timing for each cylinder. Based on the estimated air-fuel-ratio of each cylinder, the air-fuel-ratio of each cylinder is controlled. Such a control is referred to as a cylinder-by-cylinder air-fuel-ratio control.

Specifically, as shown in FIG. 2, an air-fuel-ratio estimation portion 43 estimates the air-fuel-ratio of each cylinder based on the detection value (actual air-fuel-ratio of the exhaust gas flowing through the confluent portion 34*a*) of the air-fuel-ratio sensor 36 by using of an air-fuel-ratio estimation model, which will be described later. A reference air-fuel-ratio computation portion 44 computes an average value of the estimated air-fuel-ratio of all cylinders. The computed average value is defined as a reference air-fuel-ratio (target air-fuel-ratio of all cylinders). Then, an air-fuel-ratio deviation computation portion 45 computes a deviation between the estimated air-fuel-ratio of each cylinder and the reference air-fuel-ratio. An air-fuel-ratio control portion 46 computes a fuel correction quantity for each cylinder so that the deviation between the estimated air-fuel-ratio of each cylinder and the reference air-fuel-ratio becomes smaller. The fuel injection quantity of each cylinder is corrected based on the calculating result. The air-fuel-ratio of the air-fuel mixture supplied to each cylinder is corrected so that the air-fuel-ratio dispersion between cylinders becomes smaller.

The air-fuel-ratio estimation model will be specifically described, hereinafter. The air-fuel-ratio estimation model is for estimating the air-fuel-ratio of each cylinder based on the detection value (actual air-fuel-ratio of the exhaust gas flowing through the confluent portion)

In view of a heat exchange in the confluent portion 34*a*, the detected value of the air-fuel-ratio sensor 36 is modeled by adding a history of the estimated air-fuel-ratio of each cylinder at the confluent portion 34*a* to a history of the detected value of the air-fuel-ratio sensor 36. The histories are multiplied by a specified weight. Based on the above model, the air-fuel-ratio of each cylinder is estimated. Kalman filter is used as an observer.

More specifically, a model of gas-exchange at the confluent portion 34*a* is approximated by the following formula (1):

$$ys(t)=k1\times u(t-1)+k2\times u(t-2)-k3\times ys(t-1)-k4\times ys(t-2) \quad (1)$$

wherein "ys" represents a detected value of the air-fuel-ratio sensor 36, "u" represents an air-fuel-ratio of gas flowing into the fluent-portion 34*a*, and "k1" to "k4" represent constants.

In the exhaust system, there are a first order lag of exhaust gas flowing into the confluent portion 34*a* and a first order lag of a response of the air-fuel-ratio sensor 36. In view of these first order lags, the past two histories are referred in the above formula (1).

The above formula (1) is converted into a state space model, whereby following formulas (2a) and (2b) are derived.

$$X(t+1)=A\cdot X(t)+B\cdot u(t)+W(t) \quad (2a)$$

$$Y(t)=C\cdot X(t)+D\cdot u(t) \quad (2b)$$

wherein, "A", "B", "C" and "D" represent parameters of the model, "Y" represents the detected value of the air-fuel-ratio sensor 36, "X" represents the estimate air-fuel-ratio of each cylinder as a state variable, and "W" represents noise.

Furthermore, based on the above formulas (2a) and (2b), the Kalman filter is obtained as shown by the following formula (3).

$$\hat{X}(k+1|k)=A\cdot\hat{X}(k|k-1)+K\{Y(k)-C\cdot A-\hat{X}(k|k-1)\} \quad (3)$$

wherein "X^" represents the estimated air-fuel-ratio of each cylinder and "K" represents Kalman gain. X^(k+1|k) represents to obtain an estimation value at a time (k+1) based on the estimation value at a time (k).

As described above, the air-fuel-ratio estimation model is configured by Kalman-filter type observer, whereby the air-fuel-ratio of each cylinder can be successively estimated along with an advance of a combustion cycle.

Next, a method for establishing the air-fuel-ratio detection timing of each cylinder will be explained. In view of a response delay of the air-fuel-ratio sensor, the air-fuel-ratio detection timing of each cylinder is established according to an engine driving condition (engine speed, engine load, etc.) by use of a map. The output of the air-fuel-ratio sensor 36 is transmitted to the ECU 39. Since the response delay of an exhaust gas system becomes larger as the engine load becomes smaller, the air-fuel-ratio detection timing is established in such a manner as to shift in a retard direction as the engine load becomes smaller.

However, a length of the exhaust manifold 35 from the exhaust port of each cylinder to the air-fuel-ratio sensor 36 is different between each cylinder. The flow of the exhaust gas emitted from each cylinder varies according to the engine driving condition. Further, the response delay of the air-fuel-ratio sensor varies due to a manufacture dispersion of the engine 11 and deterioration with age. Thus, it is difficult to accurately make a map between the response delay of the air-fuel-ratio sensor and an engine load before the engine is designed and manufactured. The air-fuel-ratio detection timing of each cylinder may deviate from the proper air-fuel-ratio detection timing.

If the air-fuel-ratio detection timing deviates, an estimation accuracy of the air-fuel-ratio of each cylinder is deteriorated and the dispersion of the estimated air-fuel-ratio between cylinders does not become smaller even if the cylinder-by-cylinder air-fuel-ratio control is continued.

According to the first embodiment, the ECU 39 executes each of routines shown in FIGS. 7 to 12, whereby an air-fuel-ratio detection timing determination is executed. In the air-fuel-ratio detection timing determination, the ECU 39 determines whether a deviation in air-fuel-ratio detection timing exists based on the estimated air-fuel-ratio while the cylinder-by-cylinder air-fuel-ratio control is performed. When the ECU 39 determines that the deviation exists, the air-fuel-ratio detection timing is corrected.

According to the present embodiment, the ECU 39 computes an observation residual based on the detected value of the air-fuel-ratio sensor 36 (actual air-fuel-ratio) and the estimated air-fuel-ratio. When the observation residual is greater than or equal to a specified threshold value, the ECU 39 prohibits the air-fuel-ratio detection timing determination. Therefore, when the observation residual is still large before the estimated air-fuel-ratio of each cylinder is converged, or when the observation residual is still large due to a temporal deterioration in estimating accuracy of the estimated air-fuel-ratio, the air-fuel-ratio detection timing determination can be prohibited. Thus, it can be avoided determining that the air-fuel-ratio detection timing deviates from a proper timing even though the air-fuel-ratio detection timing does not deviate.

Figure 3:
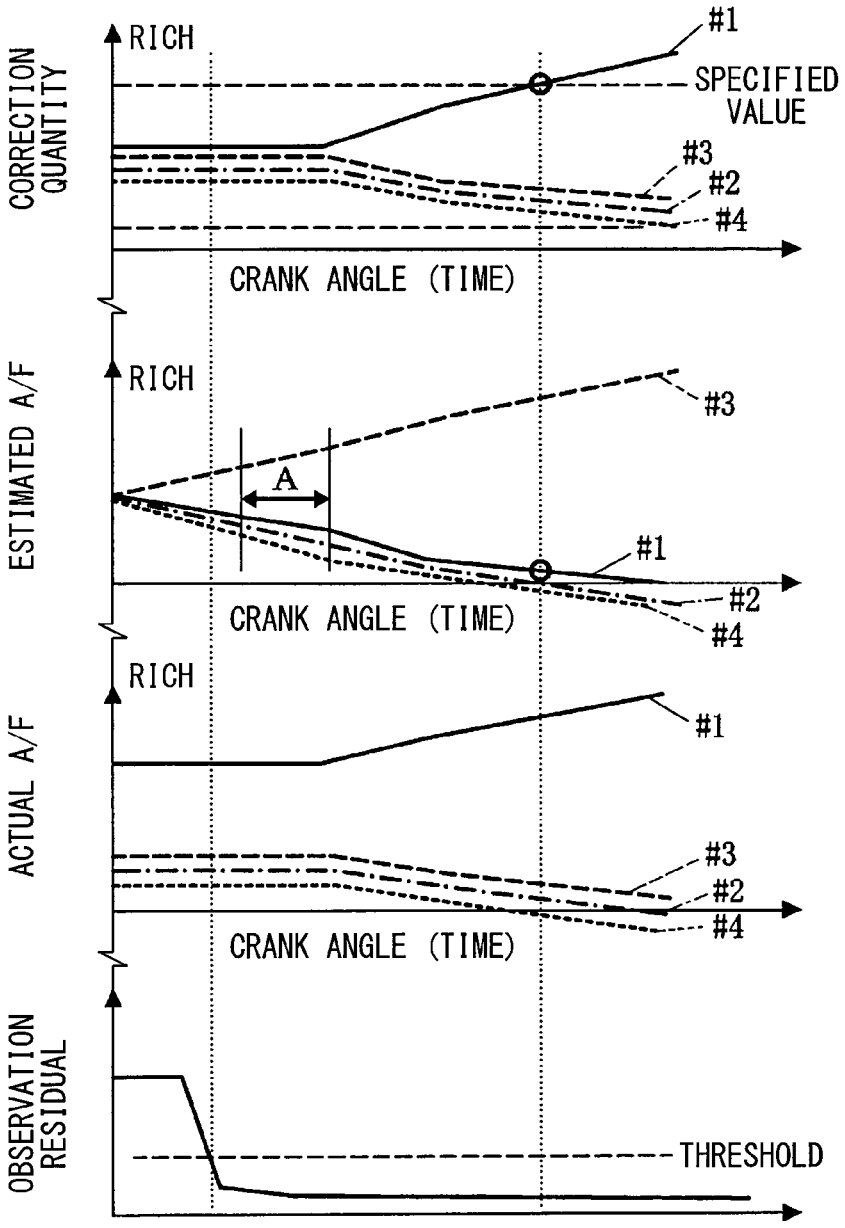
FIG. 3 is a chart showing the air-fuel-ratio detection timing determination.

According to the present embodiment, the air-fuel-ratio detection timing determination is performed as follows: That is, as shown in FIG. 3, when the observation residual becomes smaller than the specified threshold value after starting of an air-fuel-ratio estimation for each cylinder, it is permitted to execute the cylinder-by-cylinder air-fuel-ratio control and the air-fuel-ratio detection timing determination. When it is permitted to execute the cylinder-by-cylinder air-fuel-ratio control, the ECU 39 computes an initial estimated air-fuel-ratio for each cylinder based on the estimated air-fuel-ratio in a specified period "A" before starting of the cylinder-by-cylinder air-fuel-ratio control. Then, when a correction quantity for each cylinder (for example, fuel correction quantity of each cylinder) has exceeded a specified value in the cylinder-by-cylinder air-fuel-ratio control, the ECU 39 determines whether the estimated air-fuel-ratio of the cylinder significantly deviate from the initial estimated air-fuel-ratio. When the estimated air-fuel-ratio of the cylinder significantly deviates from the initial estimated air-fuel-ratio, the ECU 39 determines that a deviation in air-fuel-ratio detection timing exists.

That is, when the correction quantity for each cylinder has exceeds a specified value in the cylinder-by-cylinder air-fuel-ratio control and the estimated air-fuel-ratio of the cylinder significantly deviate from the initial estimated air-fuel-ratio, the estimated air-fuel-ratio is diverged even though the correction quantity for each cylinder becomes large to some extent. The ECU 39 determines that the deviation of the air-fuel-ratio detection timing exists.

Further, when the ECU 39 determines that the deviation exists, the air-fuel-ratio detection timing is corrected as follows: That is, a Local-learning is first executed. In the Local-learning, the air-fuel-ratio detection timing is corrected so that dispersion of the detection values of the air-fuel-ratio sensor 36 becomes maximum in one cycle (720° CA) of the engine 11. After executing the Local-learning, a Global-learning is executed. In the Global-learning, the air-fuel-ratio detection timing is corrected based on a relationship between a variation of the estimated air-fuel-ratio of at least one cylinder and a variation of the fuel correction quantity (correction amount of fuel quantity). It should be noted that the estimated air-fuel-ratio is assumed to correspond to one of cylinders #1 to #4. In the Global-learning, the cylinder corresponding to the estimated air-fuel-ratio is hypothetically varied from the cylinder #1 to the cylinder #4. With respect to at least one of the cylinders #1 to #4, a correlation coefficient between the variation of the estimated air-fuel-ratio and the variation of the fuel correction quantity is computed. Then, the air-fuel-ratio detection timing is corrected so that this correlation coefficient becomes a maximum value.

Figure 4B:
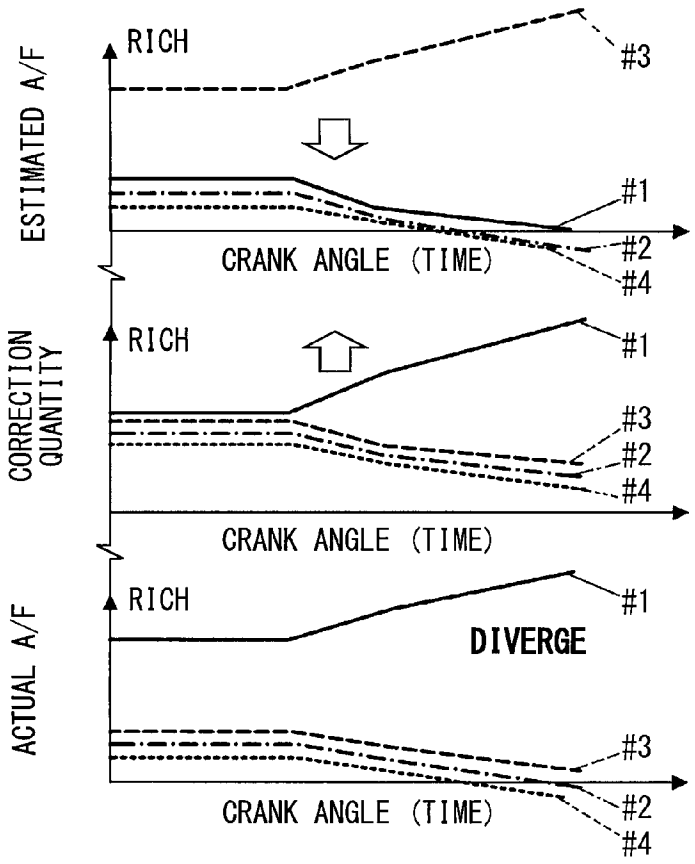
FIGS. 4A and 4B are charts showing an estimated air-fuel-ratio of each cylinder, a correction quantity for each cylinder, and an actual air-fuel-ratio of each cylinder.
Figure 4A:
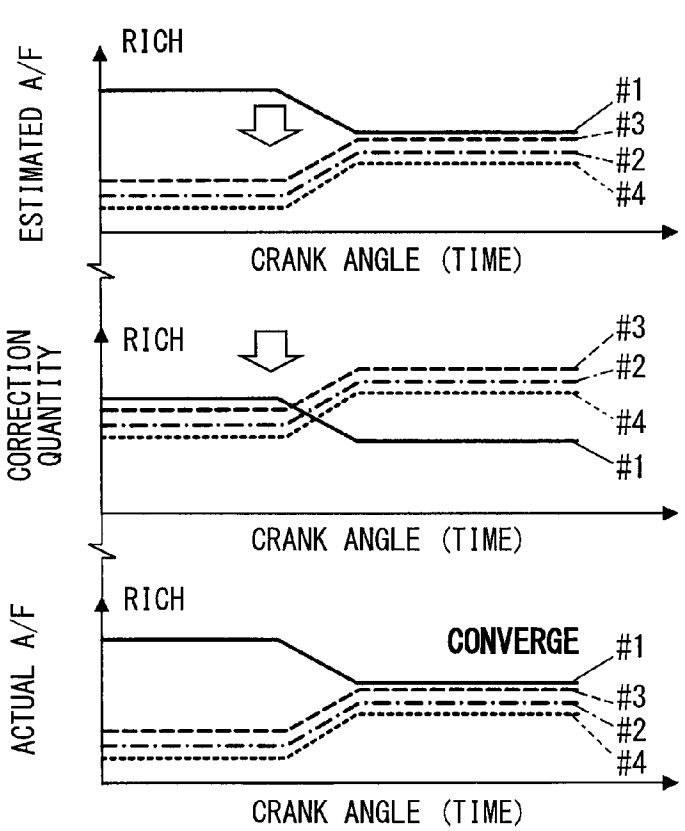

When the air-fuel-ratio detection timing of one cylinder deviates, it is not always that its correct air-fuel-ratio detection timing is close to the current air-fuel-ratio detection timing of the cylinder. For example, it can be assumed that the current air-fuel-ratio detection timing may be an air-fuel-ratio detection timing of a successive combustion cylinder or may be more retarded. Alternatively, it can be assumed that the current air-fuel-ratio detection timing may be an air-fuel-ratio detection timing of a previous combustion cylinder or may be more advanced. For example, as shown in FIG. 4B, in a case that the correct air-fuel-ratio detection timing of the first cylinder #1 is brought into the current air-fuel-ratio detection timing of the third cylinder #3, an air-fuel-ratio detection timing at which the actual air-fuel-ratio of the first cylinder #1 is most correctly detected is the current air-fuel-ratio detection timing of the third cylinder #3, not of the first cylinder #1. If the cylinder-by-cylinder air-fuel-ratio control is executed based on the fuel correction quantity that is computed based on the estimated air-fuel-ratio of the first cylinder #1 that is estimated at the current air-fuel-ratio detection timing of the first cylinder #1, the actual air-fuel-ratio of the first cylinder #1 varies according to the variation of the fuel correction quantity of the first cylinder #1. However, the estimated air-fuel-ratio of the first cylinder #1 is not varied according to the variation of the fuel correction quantity of the first cylinder #1. The estimated air-fuel-ratio of the third cylinder #3 is varied according to the variation of the correction quantity of the first cylinder #1. FIG. 4A shows a case in which no deviation in air-fuel-ratio detection timing exists.

In view of the above characteristics, according to the present embodiment, the Global-learning is executed in order to correct the air-fuel-ratio detection timing based on the relationship between the variation of the estimated air-fuel-ratio of at least one cylinder and the variation of the correction quantity (fuel correction quantity). Thus, a deviation of the air-fuel-ratio detection timing can be corrected.

Furthermore, in the Global-learning, the cylinder corresponding to the estimated air-fuel-ratio is hypothetically varied from the cylinder #1 to the cylinder #4. With respect to at least one of the cylinders #1 to #4, a correlation coefficient between the variation of the estimated air-fuel-ratio and the variation of the fuel correction quantity is computed. Based on the correlation coefficient, the air-fuel-ratio detection timing is corrected. Thereby, it is unnecessary to compute the correlation coefficient by shifting the current air-fuel-ratio detection timing sequentially. Based on the estimated air-fuel-ratio and the correction quantity at the current air-fuel-ratio detection timing, each correlation coefficient of the assumption cylinder hypothetically changed can be computed simultaneously. Even if the most appropriate air-fuel-ratio detection timing deviates from the current air-fuel-ratio detection timing significantly, the deviation therebetween can be corrected in a short time period.

For example, in a case that the correct air-fuel-ratio detection timing of the first cylinder #1 is brought into a middle time point between the current air-fuel-ratio detection timings of the second cylinder #2 and the fourth cylinder #4, an air-fuel-ratio detection timing at which the actual air-fuel-ratio of the first cylinder #1 is most correctly detected is the middle time point between the current air-fuel-ratio detection timings of the second cylinder #2 and the fourth cylinder #4, not of the first cylinder #1. Since the estimated air-fuel-ratio at the air-fuel-ratio detection timing that is most correlative to the correction quantity of the first cylinder #1 can to be obtained by an estimation at the current air-fuel-ratio detection timing, it is likely that the air-fuel-ratio detection timing cannot be corrected to the most appropriate time. Therefore, it is preferable that any one of the detection value of the air-fuel sensor 36 at the air-fuel-ratio detection timing of each cylinder is the correct value of the actual air-fuel-ratio of one of the cylinders.

According to the present embodiment, in the Local-learning, the air-fuel-ratio detection timing is corrected so that the dispersion of the detection values of the air-fuel-ratio sensor 36 becomes maximum in one cycle (720° CA) of the engine 11. Although the actual air-fuel-ratio varies in one cycle of the engine, the variation in air-fuel-ratio can be detected as much as possible. Any one of detected values of the air-fuel-ratio sensor 36 detected at the air-fuel-ratio detection timing of one cylinder accurately represents the actual air-fuel-ratio of the cylinder. Thereby, any one of the estimated air-fuel-ratio of one cylinder represents the actual air-fuel-ratio of the cylinder. In the Global-learning, a deviation of the air-fuel-ratio detection timing between cylinders can be accurately corrected.

Referring to FIGS. 5 to 12, a processing of each routine which the ECU 39 executes will be described hereinafter.

[Cylinder-by-Cylinder Air-Fuel-Ratio Estimation Routine]

A cylinder-by-cylinder air-fuel-ratio estimation routine shown in FIG. 4 is executed in synchronization with an output pulse of the crank angle sensor 33. This cylinder-by-cylinder air-fuel-ratio estimation routine corresponds to a cylinder-by-cylinder air-fuel-ratio estimation portion. In step 101, the computer of the ECU 39 determines whether an execution condition of the cylinder-by-cylinder air-fuel-ratio control is established. The execution condition includes following conditions (1)-(4):

(1) The air-fuel-ratio sensor 36 is activated.

(2) The air-fuel-ratio sensor 36 has no malfunction.

(3) The engine 11 is in warming-up condition (for example, coolant temperature is higher than a specified temperature).

(4) An engine driving region (for example, engine speed and intake air pressure) is a driving region in which an air-fuel-ratio estimation accuracy can be ensured.

When the above four conditions (1)-(4) are satisfied, the execution condition of cylinder-by-cylinder air-fuel-ratio control is established. If at least one of the conditions is not satisfied, the execution condition is not established. When the execution condition is not established, the routine ends.

Meanwhile, when the execution condition is established, the procedure proceeds to step 102 in which the air-fuel-ratio detection timing of each cylinder is established in view of a map according to the current engine load (for example, intake air pressure). Alternatively, the air-fuel-ratio detection timing of each cylinder may be established in view of a map according to the current engine load and the current engine speed. The map for establishing the air-fuel-ratio detection timing is corrected by executing the Local-learning routine shown in FIG. 9 and the Global-learning routine shown in FIG. 11.

Then, the procedure proceeds to step 103 in which the computer determines whether the current crank angle corresponds to the air-fuel-ratio detection timing established in step 102. When the answer is NO, the routine ends.

When the answer is YES in step 103, the procedure proceeds to step 104 in which the computer reads the output (air-fuel-ratio detection value) of the air-fuel-ratio sensor 36. Then, the procedure proceeds to step 105 in which the air-fuel-ratio of the cylinder that is subject to estimate is estimated based on the detection value of the air-fuel-ratio sensor 36 by using of the air-fuel-ratio estimation model.

[Cylinder-by-Cylinder Air-Fuel-Ratio Control Routine]

A cylinder-by-cylinder air-fuel-ratio control routine shown in FIG. 6 is executed in synchronization with an output pulse of the crank angle sensor 33. This cylinder-by-cylinder air-fuel-ratio control routine corresponds to a cylinder-by-cylinder air-fuel-ratio control portion. In step 201, the computer determines whether the above execution condition of the cylinder-by-cylinder air-fuel-ratio control is established. When the execution condition is not established, the routine ends.

When the execution condition is established, the procedure proceeds to step 202 in which the observation residual "err" is computed based on the detected value $\phi$ (actual air-fuel-ratio of the emission gas flowing through the confluent portion 34*a*) of the air-fuel-ratio sensor 36 and the estimated air-fuel-ratio $\theta\hat{}$, according to the following formula (4). The observation residual "err" is normalized by means of amplitude of the detected value $\phi$. The amplitude of the detected value corresponds to a difference between the detected value $\phi$ and a target air-fuel-ratio $t\phi$. It should be noted that the detected value $\phi$, the estimated air-fuel-ratio $\phi\hat{}$, and the target air-fuel-ratio $t\phi$ are respectively expressed by equivalent ratios (inverse number of the excess air ratio).

$$err = \frac{1}{\tau \times s + 1} \times \sqrt{\frac{(\phi - t\phi - \phi\hat{})^2}{(\phi - t\phi)^2}} \tag{4}$$

In the above formula (4), "$\tau$" is time constant and "s" is Laplace operator. The process in step 202 corresponds to a residual computing portion. Then, the procedure proceeds to step 203 in which the computer determines whether a permit flag of cylinder-by-cylinder air-fuel-ratio control is "1". That is, computer determines whether the cylinder-by-cylinder air-fuel-ratio control is permitted. When the computer determines that the permit flag is "0" in step 203, the procedure proceeds to step 204 in which the computer determines whether the observation residual "err" is less than a permission threshold "K1on".

When the answer is NO in step 204, the procedure proceeds to step 206 in which the permit flag is kept "0" and the Kalman gain "K" of the cylinder-by-cylinder air-fuel-ratio estimation model is kept at high gain "Khigh". The high gain "Khigh" is set larger than a low gain "Klow".

When the answer is YES in step 204, the procedure proceeds to step 207 in which the permit flag is set to "1" and the Kalman gain "K" is switched into the low gain "Klow".

The low gain "Klow" is set smaller than the high gain "Khigh".

When the computer determines that the permit flag is "1" in step 203, the procedure proceeds to step 205 in which the computer determines whether the observation residual "err" is smaller than a prohibition threshold "K1off". The prohibition threshold "K1off" is set larger than the permission threshold "K1on".

When the observation residual "err" is smaller than a prohibition threshold "K1off" in step 205, the procedure proceeds to step 207 in which the permit flag is kept "1" and the Kalman gain "K" is also kept at the low gain "Klow".

When the observation residual "err" is not smaller than a prohibition threshold "K1off" in step 205, the procedure proceeds to step 206 in which the permit flag is reset to "0" and the Kalman gain "K" is switched into the high gain "Khigh". The processes in steps 203 to 207 correspond to an air-fuel-ratio control prohibiting portion and a gain-switching portion.

While the permit flag has been "1", the procedure proceeds to step 208 in which the computer determines whether an initial-value-computation flag is "1". When initial-value-computation flag is "1", a computation of an initial estimated air-fuel-ratio has been completed. When the computer determines that the initial-value-computation flag is "0" in step 208 (computation of the initial estimated air-fuel-ratio has not been completed), the procedure proceeds to step 209 in which the initial estimated air-fuel-ratio "init $\hat{\phi}$#i" of each cylinder is computed according to the following formula.

$$\text{init}\hat{\phi}\#i=\{1/(\tau\times 2\times s+1)\}\times\hat{\phi}\#i \quad (5)$$

It should be noted that $\hat{\phi}$#i represents a currently estimated air-fuel-ratio of i-th cylinder #i, and init $\hat{\phi}$#i is the initial estimated air-fuel-ratio of i-th cylinder.

Then, the procedure proceeds to step 210 in which a count value of an initial-value-computation counter is incremented. In step 211, the computer determines whether the count value of the initial-value-computation counter is greater than a specified value. When the answer is NO in step 211, the initial-value-computation flag is kept "0" to end the routine.

When the answer is YES in step 211, the procedure proceeds to step 212 in which the initial-value-computation flag is set to "1" to end the routine.

In the above processes of steps 208 to 212, the initial estimated air-fuel-ratio init $\hat{\phi}$#i is computed based on the estimated air-fuel-ratio $\hat{\phi}$#i in a specified period before the cylinder-by-cylinder air-fuel-ratio control is started. The cylinder-by-cylinder air-fuel-ratio control is prohibited until the computation of the initial estimated air-fuel-ratio init $\hat{\phi}$#i is completed. These processes correspond to an initial value computing portion.

When the computer determines that the initial-value-computation flag is "1" in step 208 (computation of the initial estimated air-fuel-ratio has been completed), the procedure proceeds to step 213. In step 213, the computer computes an average value of the estimated air-fuel-ratio of all cylinders. The computed average value is defined as a reference air-fuel-ratio base $\phi$.

Then, the procedure proceeds to step 214 in which the computer computes a deviation (base $\phi-\hat{\phi}$#i) between the estimated air-fuel-ratio $\hat{\phi}$#i of each cylinder and the reference air-fuel-ratio base $\phi$. Further, the computer computes a fuel correction quantity Cmp#i according to the following formula so that the deviation (base $\phi-\hat{\phi}$#i) becomes smaller.

$$\text{Cmp}\#i=\int(\text{base } \phi-\hat{\phi}\#i)dt \quad (6)$$

Cmp#i represents the fuel correction quantity of i-th cylinder #i. That is, the fuel correction quantity is computed for each cylinder, as a cylinder-by-cylinder correction quantity.

Besides, when performing the air-fuel-ratio detection timing determination, the variation in cylinder-by-cylinder correction quantity is restricted. Specifically, during a period in which the permit flag is "1", a variation (increased quantity or decreased quantity) of the fuel correction quantity Cmp#i is restricted to be less than or equal to a specified guard value.

Then, the procedure proceeds to step 215 in which the fuel injection quantity of each cylinder is corrected based on the fuel correction quantity Cmp#i, whereby the air-fuel-ratio dispersion between cylinders is reduced.

[Air-Fuel-Ratio Detection Timing Determination Routine]

Figure 7:
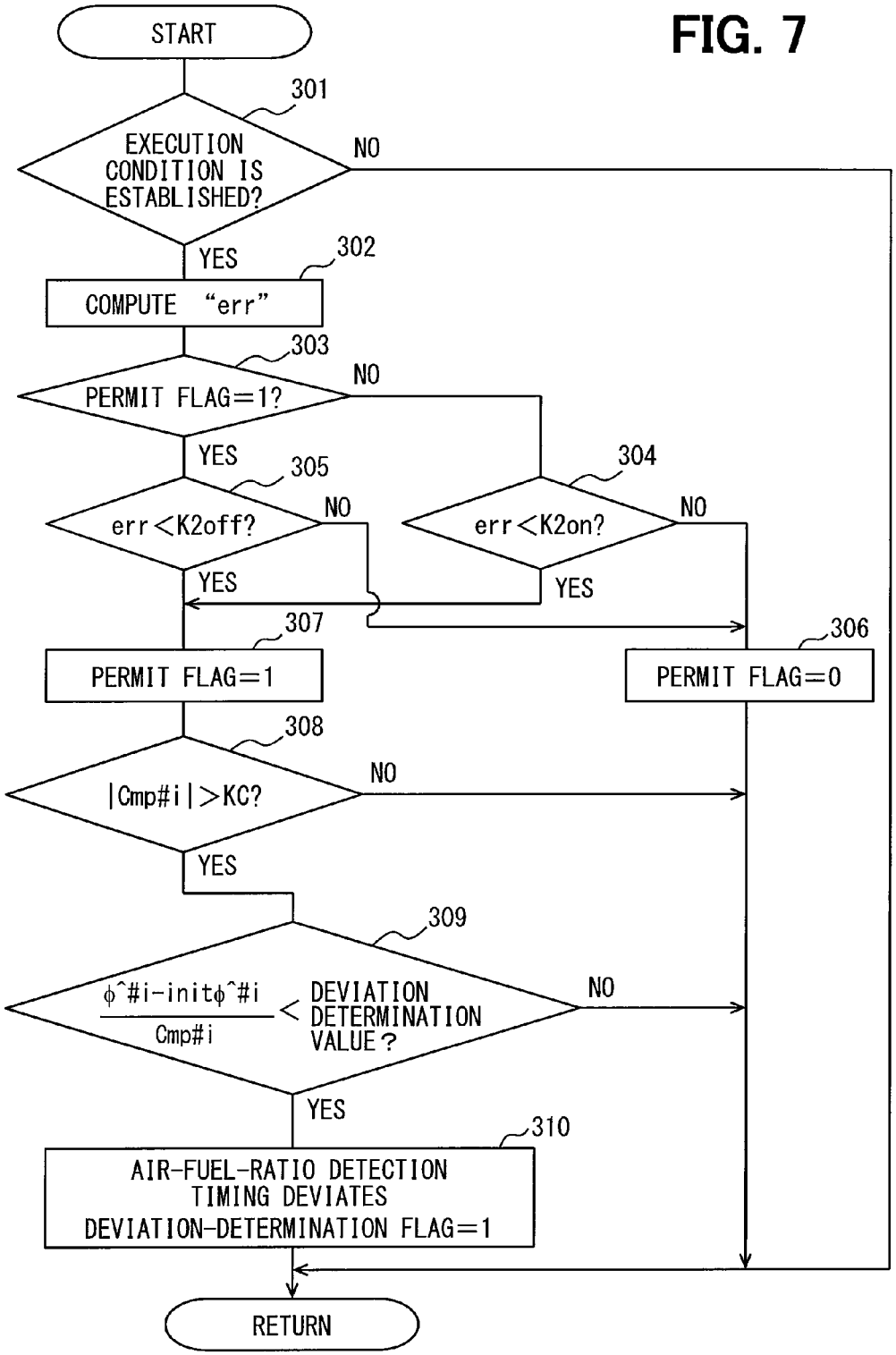
FIG. 7 is a flow chart showing a processing of an air-fuel-ratio detection timing deviation determination routine.

An air-fuel-ratio detection timing determination routine shown in FIG. 7 is executed in synchronization with an output pulse of the crank angle sensor 33. This air-fuel-ratio detection timing determination routine corresponds to a timing determination portion. In step 301, the computer determines whether the above execution condition of the cylinder-by-cylinder air-fuel-ratio control is established. When the execution condition is not established, the routine ends.

When the execution condition is established, the procedure proceeds to step 302 in which the observation residual "err" is computed based on the detected value $\phi$ of the air-fuel-ratio sensor 36 and the estimated air-fuel-ratio $\hat{\phi}$, according to the above formula (4). The process in step 302 also corresponds to the residual computing portion.

Then, the procedure proceeds to step 303 in which the computer determines whether a permit flag of air-fuel-ratio detection timing determination is "1". That is, computer determines whether the air-fuel-ratio detection timing determination is permitted. When the computer determines that the permit flag of air-fuel-ratio detection timing determination is "0" in step 303, the procedure proceeds to step 304 in which the computer determines whether the observation residual "err" is less than a permission threshold "K2on" of air-fuel-ratio detection timing determination. The permission threshold "K2on" is less than or equal to the above permission threshold "K1on".

When the answer is NO in step 304, the procedure proceeds to step 306 in which the permit flag of air-fuel-ratio detection timing determination is maintained to "0."

When the answer is YES in step 304, the procedure proceeds to step 307 in which the permit flag of air-fuel-ratio detection timing determination is set to "1".

When the computer determines that the permit flag of air-fuel-ratio detection timing determination is "1" in step 303, the procedure proceeds to step 305 in which the computer determines whether the observation residual "err" is smaller than a prohibition threshold of air-fuel-ratio detection timing determination "K2off". The prohibition threshold "K2off" is greater than the permission threshold "K2on" and is not greater than the prohibition threshold "K1off".

When the observation residual "err" is smaller than the prohibition threshold "K2off" in step 305, the procedure proceeds to step 307 in which the permit flag of air-fuel-ratio detection timing determination is kept "1".

When the observation residual "err" is not smaller than a prohibition threshold "K2off" in step 305, the procedure proceeds to step 306 in which the permit flag of air-fuel-ratio detection timing determination is reset to "0".

The processes in steps 303 to 307 correspond to an air-fuel-ratio detection timing determination prohibiting portion.

While the permit flag of air-fuel-ratio detection timing determination has been "1", the procedure proceeds to step 308 in which the computer determines whether an absolute value of the fuel correction quantity Cmp#i becomes greater than a specified value "KC". The specified value "KC" is defined according to a maximum value or an average value of the initial estimated air-fuel-ratio init $\hat{\phi}$#i, in view of a map or a formula. In step 308, when the computer determines that the absolute value of the fuel correction quantity Cmp#i is not greater than the specified value "KC" with respect to all cylinders, the procedure ends.

When the computer determines that any one of the absolute value of the fuel correction quantity Cmp#i becomes greater than the specified value "KC", the procedure proceeds to step 309 in which the computer determines whether the estimated air-fuel-ratio $\hat{\phi}$#i of the cylinder (cylinder in which the absolute value of Cmp#i exceeds the specified value KC) further deviates from the initial estimated air-fuel-ratio init $\hat{\phi}$#i according to the following formula (7).

$$(\hat{\phi}\#i - \text{init}\ \hat{\phi}\#i)/\text{Cmp}\#i < \text{Deviation determination value(minus value)} \quad (7)$$

When the formula (7) is not established in step 309, the computer determines that the air-fuel-ratio detection timing does not deviate from the proper timing to end the routine.

On the other hand, when the formula (7) is established in step 309, the computer determines that the air-fuel-ratio detection timing deviates from the proper timing, so that the deviation-determination flag is set to "1".

[Air-Fuel-Ratio Detection Timing Deviation Correction Routine]

Figure 8:
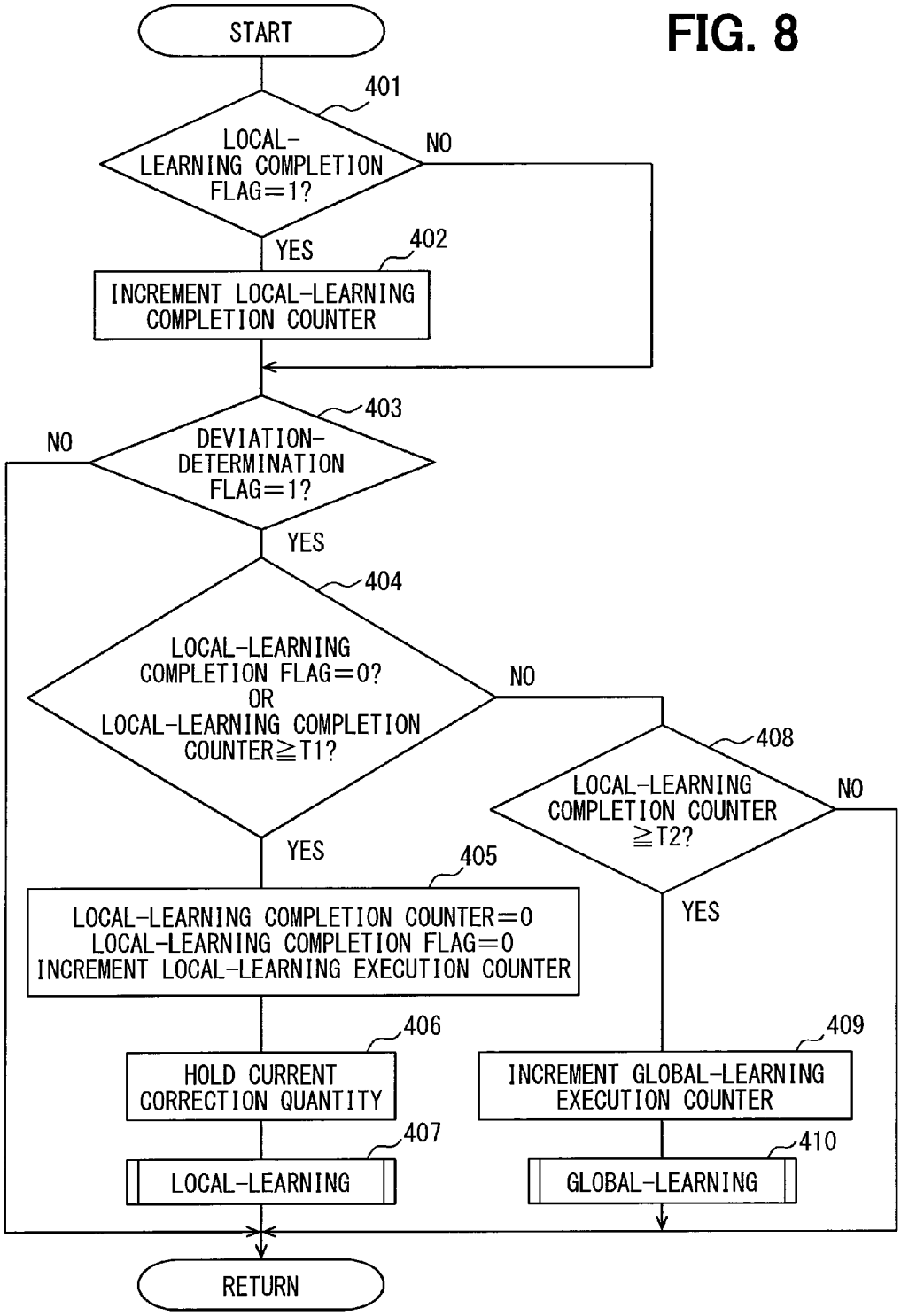
FIG. 8 is a flow chart showing a processing of an air-fuel-ratio detection timing deviation correction routine.

An air-fuel-ratio detection timing deviation correction routine shown in FIG. 8 is executed in synchronization with an output pulse of the crank angle sensor 33. In step 401, the computer determines whether a Local-learning completion flag is set to "1". When the answer is YES, the procedure proceeds to step 402 in which a Local-learning completion counter is incremented.

Then, the procedure proceeds to step 403 in which the computer determines whether the deviation-determination flag is set to "1". When the deviation-determination flag is set to "0", the routine ends.

When the computer determines that the deviation-determination flag is set to "1", the procedure proceeds to step 404 in which the computer determines whether the Local-learning completion flag is "0" or whether the counting value of the Local-learning completion counter is greater than a specified value "T1".

When the answer is NO in step 404, the procedure proceeds to step 405 in which the Local-learning completion counter is reset to "0", the Local-learning completion flag is reset to "0", and a Local-learning execution counter is incremented.

Figure 9:
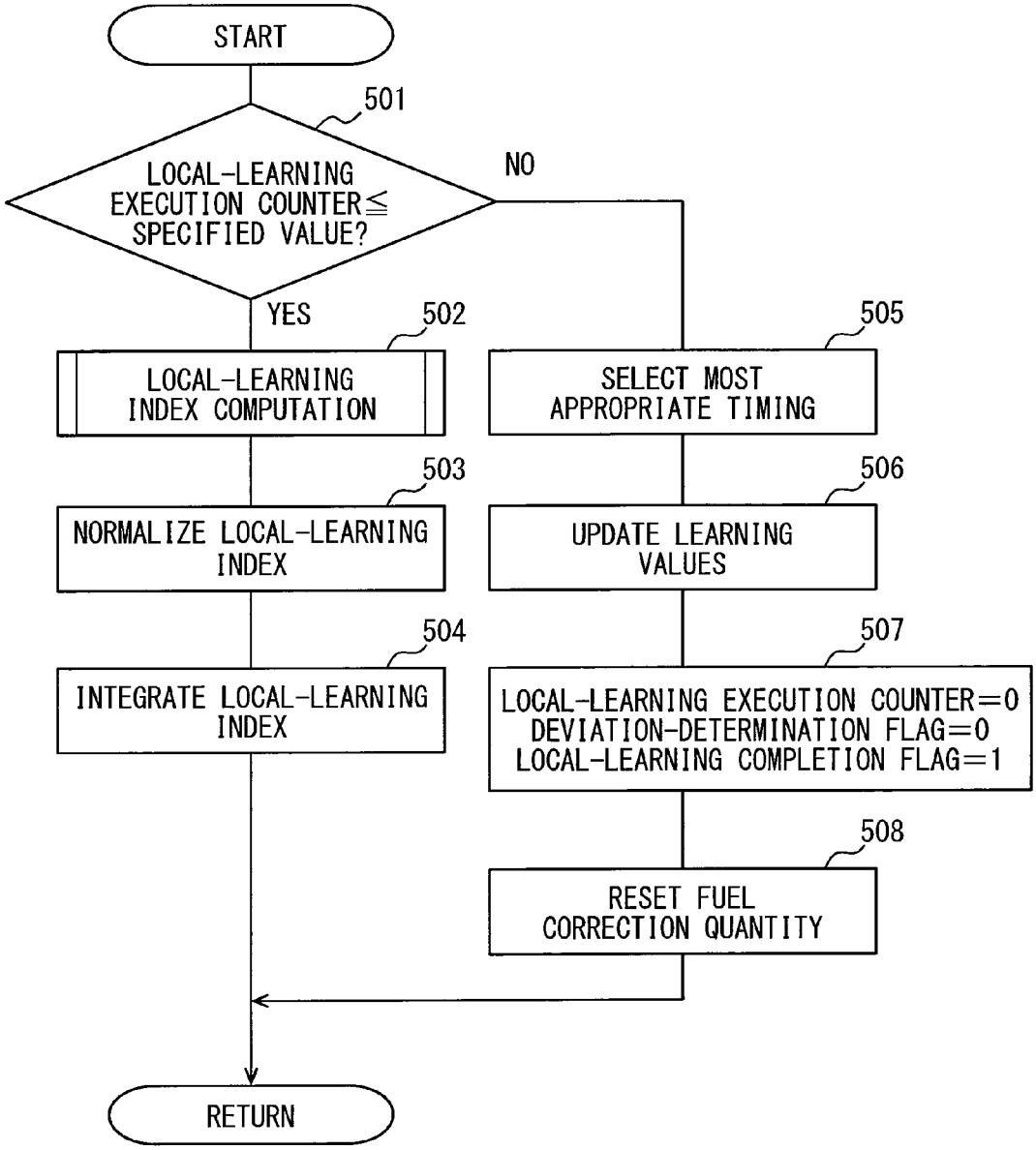
FIG. 9 is a flow chart showing a processing of a Local-learning routine.

Then, the procedure proceeds to step 406 in which the current correction quantity (fuel correction quantity) of each cylinder is held. In step 407, the Local-learning routine shown in FIG. 9 is executed. In the Local-learning, the air-fuel-ratio detection timing is corrected so that the dispersion of the detection values of the air-fuel-ratio sensor 36 becomes maximum in one cycle of the engine 11.

When the answer is NO in step 404, the procedure proceeds to step 408 in which the computer determines whether a count value of the Local-learning completion counter is greater than or equal to the specified value "T2". It should be noted that the specified value "T2" is smaller than the specified value "T1" (T2<T1).

When the answer is NO in step 408, the computer determines that a sufficient time has not elapsed after a Local-learning is completed for stabilizing the cylinder-by-cylinder air-fuel-ratio control. The routine ends.

Figure 11:
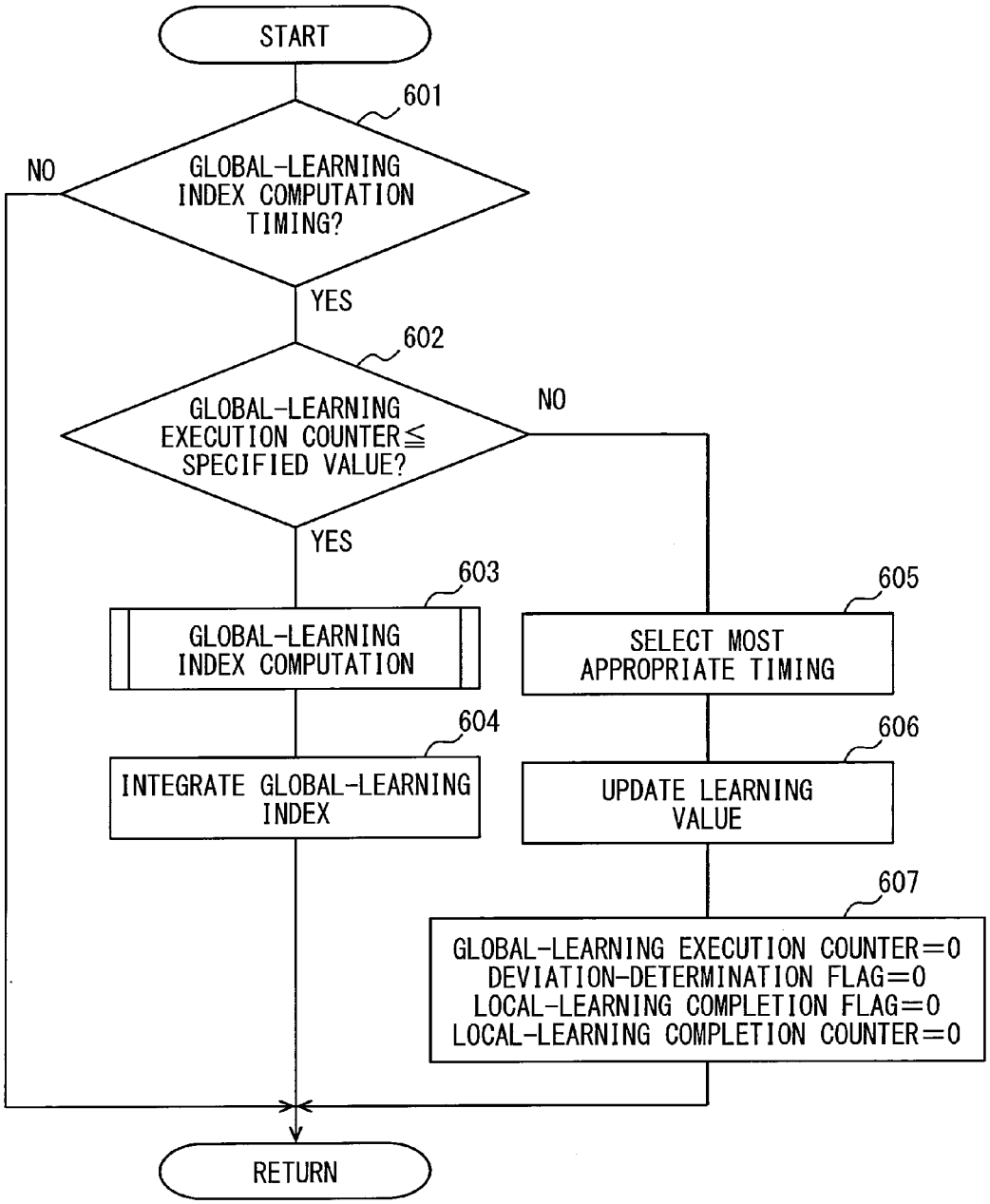
FIG. 11 is a flow chart showing a processing of a Global-learning routine.

When the computer determines that the counting value of the Local-learning completion counter has become greater than or equal to the specified value "T2" in step 408, the computer determines that a sufficient time has elapsed after the Local-learning is completed for stabilizing the cylinder-by-cylinder air-fuel-ratio control. The procedure proceeds to step 409 in which the Global-learning execution counter is incremented. In step 410, the Global-learning routine shown in FIG. 11 is executed to execute the Global-learning in which the air-fuel-ratio detection timing is corrected based on the relationship between the variation of the estimated air-fuel-ratio of each cylinder and the variation of the fuel correction quantity.

[Local-Learning Routine]

A local-learning routine shown in FIG. 9 is a subroutine executed in step 407 of the air-fuel-ratio detection timing deviation correction routine shown in FIG. 8.

In the Local-learning routine, the Local-learning is executed. The air-fuel-ratio detection timing is corrected so that the dispersion of the detection values of the air-fuel-ratio sensor 36 becomes maximum in one cycle of the engine 11. In the Local-learning, the air-fuel-ratio detection timing is corrected so that a value corresponding to a distribution of the detection values of the air-fuel-ratio sensor 36 detected at every air-fuel-ratio detection timing becomes maximum.

Figure 10:
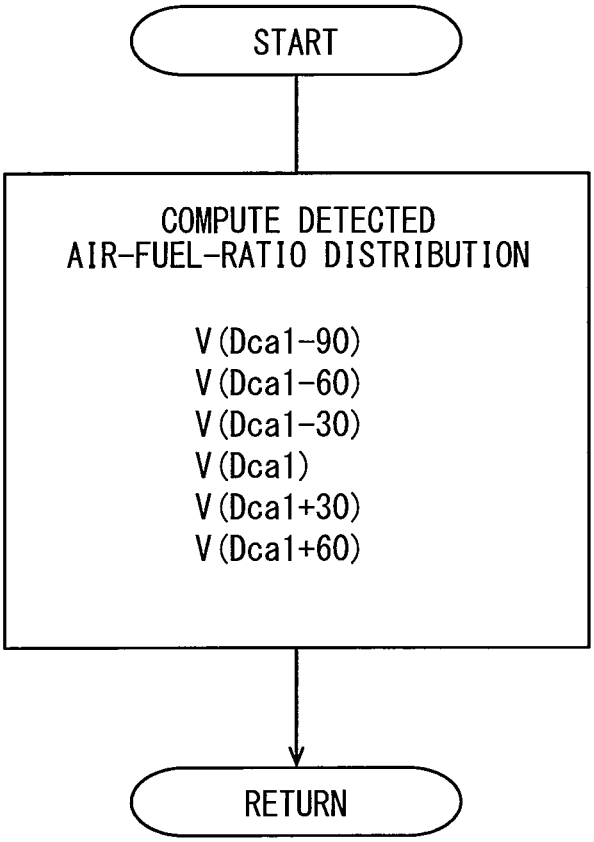
FIG. 10 is a flow chart showing a processing of a Local-learning index computation routine.

In step 501, the computer determines whether the counting value of the Local-learning execution counter is less than or equal to a specified value, which is a value corresponding to 30 cycles, for example. When the computer determines that the counting value of the Local-learning execution counter is less than or equal to a specified value in step 501, the procedure proceeds to step 502 in which a Local-learning index computation routine shown in FIG. 10 is executed. In this routine, with respect to cases where the air-fuel-ratio detection timing of the first cylinder #1 is assumed as following time "L1" to "L6"° CA, a value corresponding to a distribution of the detection values of the air-fuel-ratio sensor 36 detected at every air-fuel-ratio detection timing is computed. This computed value is referred to as a detected air-fuel-ratio distribution. The detected air-fuel-ratio distribution is defined as a Local-learning index.

(1) When it is assumed that the air-fuel-ratio detection timing of first cylinder #1 is defined as a first timing L1 (=Dca1−90), a detected air-fuel-ratio distribution V (Dca1−90) is computed according to a following formula (8):

$$V(Dcal-90) = 1/N \times \sum_{i=1}^{N} \{\phi(Dcal-90+720/N\times(i-1)) - \text{Mean}\phi(Dcal-90)\}^2 \quad (8)$$

"N" represents a number of cylinders per one air-fuel-ratio sensor 36 (for example, four). "ϕ(k)" represents a detection value of the air-fuel-ratio sensor 36 at a crank angle "k" degree. Mean ϕ(k) represents an average value of ϕ(k), ϕ(k+720/N×1), ϕ(k+720/N×2), and ϕ(k+7 20/N×3). It should be noted that ϕ(k) is represented by an equivalence ratio (inverse number of an excess air ratio).

(2) When it is assumed that the air-fuel-ratio detection timing of first cylinder #1 is defined as a second timing L2 (=Dca1−60), a detected air-fuel-ratio distribution V (Dca1−60) is computed according to a following formula (9):

$$V(Dcal-60) = 1/N \times \sum_{i=1}^{N} \{\phi(Dcal-60+720/N\times(i-1)) - \text{Mean}\phi(Dcal-60)\}^2 \quad (9)$$

(3) When it is assumed that the air-fuel-ratio detection timing of first cylinder #1 is defined as a third timing L3 (=Dca1−30), a detected air-fuel-ratio distribution V (Dca1−30) is computed according to a following formula (10):

$$V(Dcal-30)= 1/N\times\sum_{i=1}^{N}\{\phi(Dcal-30+720/N\times(i-1))-\text{Mean}\phi(Dcal-30)\}^2 \quad (10)$$

(4) When it is assumed that the air-fuel-ratio detection timing of first cylinder #1 is defined as a fourth timing L4 (=Dca1), a detected air-fuel-ratio distribution V (Dca1) is computed according to a following formula (11):

$$V(Dcal)=1/N\times\sum_{i=1}^{N}\{\phi(Dcal+720/N\times(i-1))-\text{Mean}\phi(Dcal)\}^2 \quad (11)$$

(5) When it is assumed that the air-fuel-ratio detection timing of first cylinder #1 is defined as a fifth timing L5 (=Dca1+30), a detected air-fuel-ratio distribution V (Dca1+30) is computed according to a following formula (12):

$$V(Dcal+30)= 1/N\times\sum_{i=1}^{N}\{\phi(Dcal+30+720/N\times(i-1))-\text{Mean}\phi(Dcal+30)\}^2 \quad (12)$$

(6) When it is assumed that the air-fuel-ratio detection timing of first cylinder #1 is defined as a sixth timing L6 (=Dca1+60), a detected air-fuel-ratio distribution V (Dca1+60) is computed according to a following formula (13):

$$V(Dcal+60)= 1/N\times\sum_{i=1}^{N}\{\phi(Dcal+60+720/N\times(i-1))-\text{Mean}\phi(Dcal+60)\}^2 \quad (13)$$

As described above, with respect to each case where the air-fuel-ratio detection timing of the first cylinder #1 is assumed as time "L1" to "L6"° CA, the each detected air-fuel-ratio distribution V (Local-learning index) is computed. Then, the procedure proceeds to step 503 in which the detected air-fuel-ratio distribution V(Local-learning index) is normalized with respect to each case where the air-fuel-ratio detection timing of first cylinder #1 is assumed as a time "L1" to "L6".

Specifically, with respect to each of the detected air-fuel-ratio distributions V(Dca1−90), V(Dca1−60), V(Dca1−30), V(Dca1), V(Dca1+30) and V(Dca1+60), higher score point (for example, 5 to 0 point) is added sequentially from the higher detected air-fuel-ratio distribution. These scores points Point (Dca1−90), Point (Dca1−60), Point (Dca1−30), Point (Dca1), Point (Dca1+30) and Point (Dca1+60) are defined as normalization indexes (normalized detected air-fuel-ratio distribution V).

V(Dca1−90)→Point(Dca1−90)
V(Dca1−60)→Point(Dca1−60)
V(Dca1−30)→Point(Dca1−30)
V(Dca1)→Point(Dca1)
V(Dca1+30)→Point(Dca1+30)
V(Dca1+60)→Point(Dca1+60)

Then, the procedure proceeds to step 504 in which the integrated value of normalization index is multiplied by newly obtained normalization index so that the integrated value of normalization index is updated.

When the computer determines that the counting value of the Local-learning execution counter has exceeded the specified value in step 501, the computer determines that the integrated value of the normalization index is computed for specified time period. The procedure proceeds to step 505. In step 505, a time at which the integrated value of the normalization index becomes maximum is selected as the most appropriate timing.

Then, the procedure proceeds to step 506 in which the selected most appropriate timing is learned as the air-fuel-ratio detection timing of first cylinder #1 and the air-fuel-ratio detection timing of other cylinders (the second cylinder #2—the fourth cylinder #4) are learned on the basis of the air-fuel-ratio detection timing of the first cylinder #1. These learning values are stored in a storage area of a rewritable nonvolatile memory of backup RAM of ECU 39.

Then, the procedure proceeds to step 507 in which the Local-learning execution counter is reset to "0", the deviation-determination flag is reset to "0", and the Local-learning completion flag is set to "1". Then, the procedure proceeds to step 508 in which the fuel correction quantity of each cylinder is reset to a specified value (for example, an initial value) to end the routine.

[Global-Learning Routine]

A Global-learning routine shown in FIG. 11 is a subroutine executed in step 410 of the air-fuel-ratio detection timing deviation correction routine shown in FIG. 8.

In this routine, the Global-learning is executed. In the Global-learning, the air-fuel-ratio detection timing is corrected based on the relationship between the variation of the estimated air-fuel-ratio of each cylinder and the variation of the correction quantity (fuel correction quantity) of each cylinder. In the Global-learning, the cylinder corresponding to the estimated air-fuel-ratio is hypothetically varied from the cylinder #1 to the cylinder #4. With respect to each case, a correlation coefficient between the variation of the estimated air-fuel-ratio and the variation of the correction quantity (fuel correction quantity) is computed. Then, the air-fuel-ratio detection timing is corrected so that this correlation coefficient becomes maximum.

In step 601, the computer determines whether it is Global-learning index computation timing (for example, 720° CA). When the answer is No in step 601, the procedure ends without performing the subsequent steps.

When the answer is YES in step 601, the procedure proceeds to step 602 in which the computer determines whether the counting value of a Global-learning execution counter is less than or equal to a specified value, which is a value corresponding to 30 cycles, for example.

Figures 12, 13:
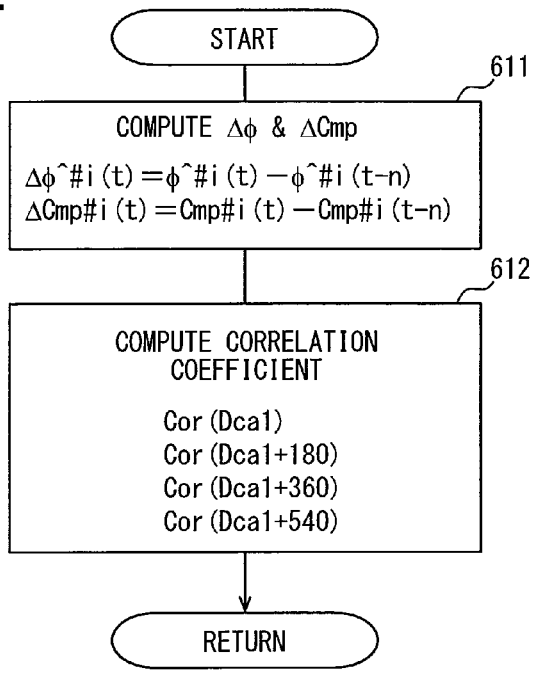
FIG. 12 is a flow chart showing a processing of a Global-learning index computation routine.
FIG. 13 is a chart showing assumed cylinders in a case that an air-fuel-ratio detection timing is assumed to be varied.

When the computer determines that the counting value of the Global-learning execution counter is less than or equal to a specified value in step 602, the procedure proceeds to step 603 in which a Global-learning index computation routine shown in FIG. 12 is executed. With respect to each case where the air-fuel-ratio detection timing of the first cylinder #1 is assumed as timing G1 to G4 (crank angle degree), a correlation coefficient between the variation of the estimated air-fuel-ratio of each cylinder and a variation of the fuel correction quantity is computed. The computed correlation coefficient is defined as a Global-learning index.

Specifically, in step 611, the computer computes a variation $\Delta\phi$ of the estimated air-fuel-ratio of each cylinder and a variation $\Delta$Cmp of the fuel correction quantity at a time of the current air-fuel-ratio detection timing, based on the following formula.

$$\Delta\hat{\phi}\#i(t)=\hat{\phi}\#i(t)-\hat{\phi}\#i(t-n) \quad (14)$$

$$\Delta\text{Cmp}\#i(t)=\text{Cmp}\#i(t)-\text{Cmp}\#i(t-n) \quad (15)$$

It should be noted that $\hat{\phi}$#i(t) represents a currently estimated air-fuel-ratio of i-th cylinder #i, and $\hat{\phi}$#i(t−n) is an estimated air-fuel-ratio of i-th cylinder estimated "n" times before. Further, Cmp#i(t) represents a currently computed fuel correction quantity of i-th cylinder #i, and Cmp#i(t−n)

is a fuel correction quantity of i-th cylinder computed "n" times before. In addition, "n" is an integer value that is greater than or equal to "1".

Then, the procedure proceeds to step 612. With respect to each case where the air-fuel-ratio detection timing of the first cylinder #1 is assumed as time G1 to G4 (crank angle degree), a correlation coefficient between the variation of the estimated air-fuel-ratio of each cylinder and a variation of the fuel correction quantity is computed.

(1) When it is assumed that the air-fuel-ratio detection timing of the first cylinder #1 is defined as the first timing G1 (=Dca1), as shown in a vertical column (a) of FIG. 13, an estimated air-fuel-ratio $\hat{\phi}$#1 of the first cylinder #1 at the current air-fuel-ratio detection timing is computed as an estimated air-fuel-ratio of the first cylinder #1, an estimated air-fuel-ratio $\hat{\phi}$#3 of the third cylinder #3 at the current air-fuel-ratio detection timing is computed as an estimated air-fuel-ratio of the third cylinder #3, an estimated air-fuel-ratio $\hat{\phi}$#4 of the fourth cylinder #4 at the current air-fuel-ratio detection timing is computed as an estimated air-fuel-ratio of the fourth cylinder #4, and an estimated air-fuel-ratio $\hat{\phi}$#2 of the second cylinder #2 at the current air-fuel-ratio detection timing is computed as an estimated air-fuel-ratio of the second cylinder #2.

Therefore, when it is assumed that the air-fuel-ratio detection timing of the first cylinder #1 is the first timing G1 (=Dca1), a correlation coefficient Cor(Dca1) can be computed according to following formula:

$$\mathrm{Cor}(Dca1)=\Delta\hat{\phi}\#1(t)\times\Delta\mathrm{Cmp}\#1(t)+\Delta\hat{\phi}\#3(t)\times\Delta\mathrm{Cmp}\#3(t)+\Delta\hat{\phi}\#4(t)\times\Delta\mathrm{Cmp}\#4(t)+\Delta\hat{\phi}\#2(t)\times\Delta\mathrm{Cmp}\#2(t) \quad (16)$$

(2) When it is assumed that the air-fuel-ratio detection timing of the first cylinder #1 is defined as the second timing G2 (=Dca1+180), as shown in a vertical column (b) of FIG. 13, an estimated air-fuel-ratio $\hat{\phi}$#1 of the first cylinder #1 at the current air-fuel-ratio detection timing is computed as an estimated air-fuel-ratio of the second cylinder #2, an estimated air-fuel-ratio $\hat{\phi}$#3 of the third cylinder #3 at the current air-fuel-ratio detection timing is computed as an estimated air-fuel-ratio of the first cylinder #1, an estimated air-fuel-ratio $\hat{\phi}$#4 of the fourth cylinder #4 at the current air-fuel-ratio detection timing is computed as an estimated air-fuel-ratio of the third cylinder #3, and an estimated air-fuel-ratio $\hat{\phi}$#2 of the second cylinder #2 at the current air-fuel-ratio detection timing is computed as an estimated air-fuel-ratio of the fourth cylinder #4.

Therefore, when it is assumed that the air-fuel-ratio detection timing of the first cylinder #1 is defined as the second timing G2 (=Dca1+180), the correlation coefficient Cor(Dca1+180) can be computed according to the following formula:

$$\mathrm{Cor}(Dca1+180)=\Delta\hat{\phi}\#3(t)\times\Delta\mathrm{Cmp}\#1(t)+\Delta\hat{\phi}\#4(t)\times\Delta\mathrm{Cmp}\#3(t)+\Delta\hat{\phi}\#2(t)\times\Delta\mathrm{Cmp}\#4(t)+\Delta\hat{\phi}\#1(t)\times\Delta\mathrm{Cmp}\#2(t) \quad (17)$$

(3) When it is assumed that the air-fuel-ratio detection timing of the first cylinder #1 is defined as the third timing G3 (=Dca1+360), as shown in a vertical column (c) of FIG. 13, an estimated air-fuel-ratio $\hat{\phi}$#1 of the first cylinder #1 at the current air-fuel-ratio detection timing is computed as an estimated air-fuel-ratio of the fourth cylinder #4, an estimated air-fuel-ratio $\hat{\phi}$#3 of the third cylinder #3 at the current air-fuel-ratio detection timing is computed as an estimated air-fuel-ratio of the second cylinder #2, an estimated air-fuel-ratio $\hat{\phi}$#4 of the fourth cylinder #4 at the current air-fuel-ratio detection timing is computed as an estimated air-fuel-ratio of the first cylinder #1, and an estimated air-fuel-ratio $\hat{\phi}$#2 of the second cylinder #2 at the current air-fuel-ratio detection timing is computed as an estimated air-fuel-ratio of the third cylinder #3.

Therefore, when it is assumed that the air-fuel-ratio detection timing of the first cylinder #1 is the third timing G3 (=Dca1+360), a correlation coefficient Cor(Dca1+360) can be computed according to a following formula:

$$\mathrm{Cor}(Dca1+360)=\Delta\hat{\phi}\#4(t)\times\Delta\mathrm{Cmp}\#1(t)+\Delta\hat{\phi}\#2(t)\times\Delta\mathrm{Cmp}\#3(t)+\Delta\hat{\phi}\#1(t)\times\Delta\mathrm{Cmp}\#4(t)+\Delta\hat{\phi}\#3(t)\times\Delta\mathrm{Cmp}\#2(t) \quad (18)$$

(4) When it is assumed that the air-fuel-ratio detection timing of the first cylinder #1 is defined as the fourth timing G4 (=Dca1+540), as shown in a vertical column (d) of FIG. 13, an estimated air-fuel-ratio $\hat{\phi}$#1 of the first cylinder #1 at the current air-fuel-ratio detection timing is computed as an estimated air-fuel-ratio of the third cylinder #3, an estimated air-fuel-ratio $\hat{\phi}$#3 of the third cylinder #3 at the current air-fuel-ratio detection timing is computed as an estimated air-fuel-ratio of the fourth cylinder #4, an estimated air-fuel-ratio $\hat{\phi}$#4 of the fourth cylinder #4 at the current air-fuel-ratio detection timing is computed as an estimated air-fuel-ratio of the second cylinder #2, and an estimated air-fuel-ratio $\hat{\phi}$#2 of the second cylinder #2 at the current air-fuel-ratio detection timing is computed as an estimated air-fuel-ratio of the first cylinder #1.

Therefore, when it is assumed that the air-fuel-ratio detection timing of the first cylinder #1 is the fourth timing G4 (=Dca1+540), a correlation coefficient Cor(Dca1+540) can be computed according to a following formula:

$$\mathrm{Cor}(Dca1+540)=\Delta\hat{\phi}\#2(t)\times\Delta\mathrm{Cmp}\#1(t)+\Delta\hat{\phi}\#1(t)\times\Delta\mathrm{Cmp}\#3(t)+\Delta\hat{\phi}\#3(t)\times\Delta\mathrm{Cmp}\#4(t)+\Delta\hat{\phi}\#4(t)\times\Delta\mathrm{Cmp}\#2(t) \quad (19)$$

As described above, with respect to each case where the air-fuel-ratio detection timing of the first cylinder #1 is assumed as the timing "G1" to "G4", the correlation coefficient "Cor" (Global-learning index) between the variation of the estimated air-fuel-ratio of each cylinder and the variation of the fuel correction quantity of each cylinder is computed. Then, the procedure proceeds to step 604 in which the integrated value of the correlation coefficient "Cor" is multiplied by newly obtained correlation coefficient "Cor" so that the integrated value of the correlation coefficient "Cor" is updated. At this time, only the plus values of the correlation coefficients "Cor" may be integrated. Alternatively, only the minus value of the correlation coefficients "Cor" may be integrated.

When the computer determines that the counting value of the Global-learning execution counter has exceeded the specified value in step 602, the computer determines that the correlation coefficient "Cor" is computed for specified time period. The procedure proceeds to step 605. In step 605, a timing at which the integrated value of the correlation coefficients "Cor" becomes maximum is selected as the most appropriate timing.

Then, the procedure proceeds to step 606 in which the selected most appropriate timing is learned as the air-fuel-ratio detection timing of first cylinder #1 and the air-fuel-ratio detection timing of other cylinders (the second cylinder #2—the fourth cylinder #4) are learned on the basis of the air-fuel-ratio detection timing of the first cylinder #1. These learning values are stored in a storage area of a rewritable nonvolatile memory of backup RAM of ECU 39.

Then, the procedure proceeds to step 607 in which the Global-learning execution counter is reset to "0", the deviation-determination flag is reset to "0", and the Local-learning completion flag is reset to "0". Further, the counting value of the Local-learning completion counter is reset to "0".

The above routine shown in FIGS. 8 to 12 corresponds to a timing correcting portion.

Besides, in a period after the Local-learning is completed until the Global-learning is completed, a feedback gain of the cylinder-by-cylinder air-fuel-ratio control may be increased. In this case, the feedback gain may be increased with respect to the specified cylinder. Alternatively, the feedback gain may be set different between cylinders.

After the Local-learning is executed to correct the air-fuel-ratio detection timing, the Global-learning is executed. In the Global-learning, the air-fuel-ratio detection timing is corrected by a combustion interval of the engine (for example, 180° CA). Alternatively, the air-fuel-ratio detection timing is multiplied twice or more. The air-fuel-ratio detection timing of each cylinder is replaced by the air-fuel-ratio detection timing of other cylinders. The air-fuel-ratio detection timing of each cylinder can be corrected to the correct air-fuel-ratio detection timing.

Figure 14:
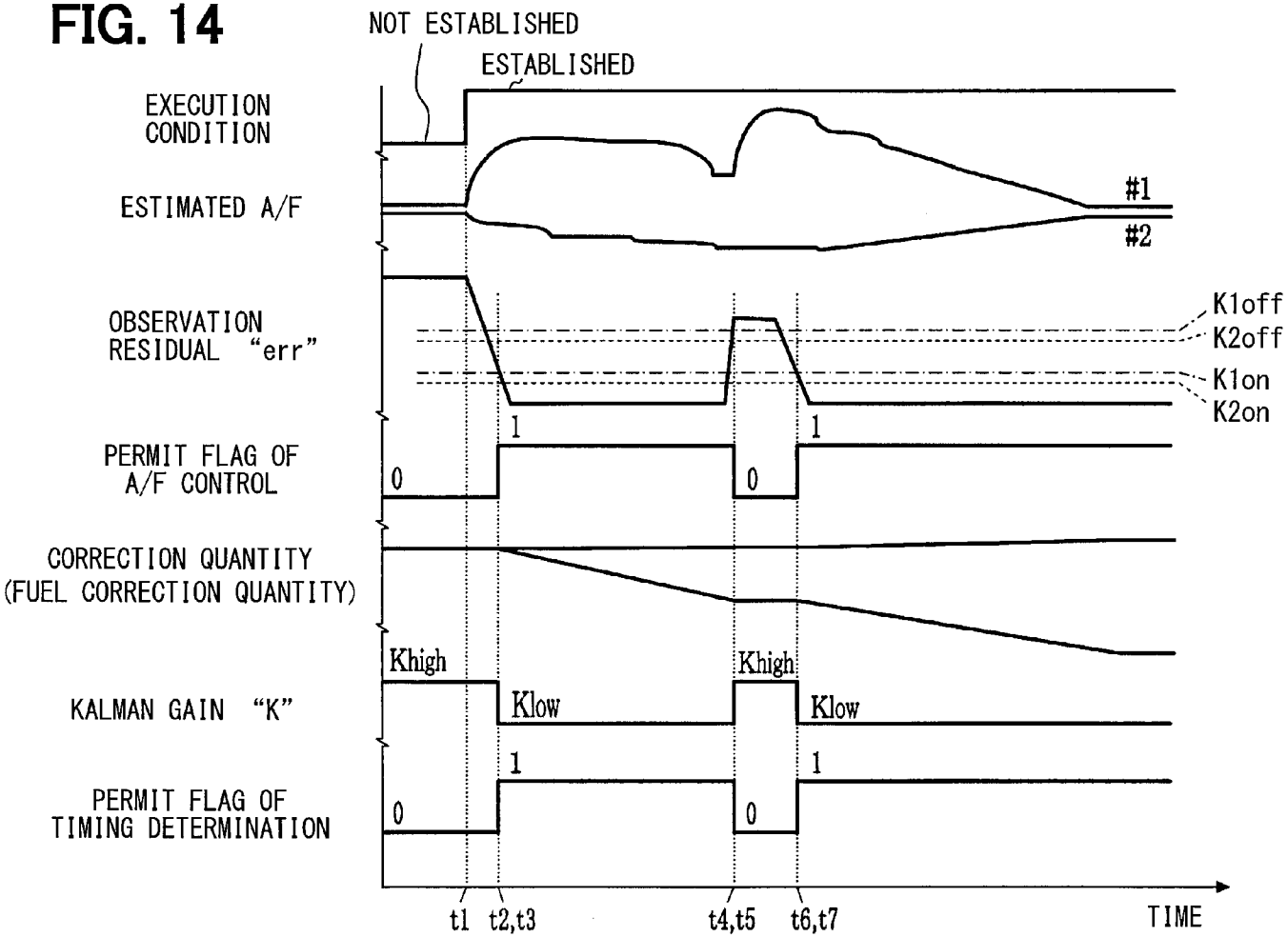
FIG. 14 is a time chart showing an example of execution of the cylinder-by-cylinder air-fuel-ratio control and the air-fuel-ratio detection timing determination.

Referring to FIG. 14, an example of execution of the cylinder-by-cylinder air-fuel-ratio control and the air-fuel-ratio detection timing determination will be described. When an execution condition of the cylinder-by-cylinder air-fuel-ratio control is established at a time t1, a cylinder-by-cylinder air-fuel-ratio estimation is started to estimate the air-fuel-ratio of each cylinder based on a detection value which the air-fuel-ratio sensor 36 detects at an air-fuel-ratio detection timing for each cylinder. Further, the ECU 39 starts computing the observation residual "err" based on the detected value of the air-fuel-ratio sensor 36 (actual air-fuel-ratio) and the estimated air-fuel-ratio.

When the observation residual "err" is greater than or equal to the permission threshold "K1on", the permit flag of cylinder-by-cylinder air-fuel-ratio control is kept "0" to prohibit the execution of the cylinder-by-cylinder air-fuel-ratio control. The Kalman gain "K" of the cylinder-by-cylinder air-fuel-ratio estimation model is kept at the high gain "Khigh". Furthermore, when the observation residual "err" is greater than or equal to the permission threshold "K2on", the permit flag of air-fuel-ratio detection timing determination is kept "0" to prohibit the execution of the air-fuel-ratio detection timing determination.

Then, when the observation residual "err" becomes less than the permission threshold "K1on" at a time t2, the permit flag of cylinder-by-cylinder air-fuel-ratio control is set to "1" to permit the execution of the cylinder-by-cylinder air-fuel-ratio control. The Kalman gain "K" is switched to the low gain "Klow". Furthermore, when the observation residual "err" becomes less than the permission threshold "K2on" at a time t3, the permit flag of air-fuel-ratio detection timing determination is set to "1" to permit the execution of the air-fuel-ratio detection timing determination.

Then, when the observation residual "err" becomes greater than or equal to the prohibition threshold "K1off" at a time t4, the permit flag of cylinder-by-cylinder air-fuel-ratio control is reset to "0" to prohibit the execution of the cylinder-by-cylinder air-fuel-ratio control. The Kalman gain "K" is switched to the high gain "Khigh". Furthermore, when the observation residual "err" becomes greater than or equal to the prohibition threshold "K2off" at a time t5, the permit flag of air-fuel-ratio detection timing determination is reset to "0" to prohibit the execution of the air-fuel-ratio detection timing determination.

Then, when the observation residual "err" becomes less than the permission threshold "K1on" at a time t6, the permit flag of cylinder-by-cylinder air-fuel-ratio control is set to "1" again to permit the execution of the cylinder-by-cylinder air-fuel-ratio control. The Kalman gain "K" is switched to the low gain "Klow". Furthermore, when the observation residual "err" becomes less than the permission threshold "K2on" at a time t7, the permit flag of air-fuel-ratio detection timing determination is set "1" again to permit the execution of the air-fuel-ratio detection timing determination.

According to the present embodiment described above, the ECU 39 computes an observation residual "err" based on the detected value of the air-fuel-ratio sensor 36 (actual air-fuel-ratio) and the estimated air-fuel-ratio. When the observation residual "err" is greater than or equal to the specified threshold value ("K2on" or "K2off"), the ECU 39 prohibits the air-fuel-ratio detection timing determination. Therefore, when the observation residual "err" is still large before the estimated air-fuel-ratio of each cylinder is converged, or when the observation residual "err" becomes larger due to a temporal deterioration in estimating accuracy of the estimated air-fuel-ratio, the air-fuel-ratio detection timing determination can be prohibited. Thus, it can be avoided determining that the air-fuel-ratio detection timing deviates from a proper timing even though the air-fuel-ratio detection timing does not deviate. The determination accuracy of the deviation of the air-fuel-ratio detection timing can be improved.

Further, when the observation residual "err" is greater than or equal to the specified threshold value ("K1on" or "K1off"), the ECU 39 prohibits the cylinder-by-cylinder air-fuel-ratio control. Therefore, when the observation residual "err" becomes larger due to a temporal deterioration in estimating accuracy of the estimated air-fuel-ratio, the cylinder-by-cylinder air-fuel-ratio control based on the estimated air-fuel-ratio can be stopped.

Moreover, when computing the observation residual "err", the observation residual "err" is normalized by means of amplitude of the detected value of the air-fuel-ratio sensor 36. Thus, the observation residual "err" that can properly evaluate the error of the estimated air-fuel-ratio can be obtained without any influence of a variation of the amplitude of the detected value of the air-fuel-ratio sensor 36.

Moreover, according to the present embodiment, the initial estimation air-fuel-ratio is computed based on the estimated air-fuel-ratio before executing the cylinder-by-cylinder air-fuel-ratio control. When the cylinder-by-cylinder correction amount exceeds the specified value "KC" and the estimated air-fuel-ratio significantly deviates from the initial estimated air-fuel-ratio, it is determined that a deviation of the air-fuel-ratio detection timing exists. That is, when the correction quantity for each cylinder has exceeds a specified value "KC" in the cylinder-by-cylinder air-fuel-ratio control and the estimated air-fuel-ratio of the cylinder significantly deviate from the initial estimated air-fuel-ratio, the estimated air-fuel-ratio is diverged even though the correction quantity for each cylinder becomes large to some extent. The ECU 39 determines that the deviation of the air-fuel-ratio detection timing exists. Therefore, the deviation of the air-fuel-ratio detection timing can be detected with high accuracy.

Furthermore, according to the present embodiment, since the execution of the cylinder-by-cylinder air-fuel-ratio control is prohibited until the computation of the estimated air-fuel-ratio is completed, the initial estimation air-fuel-ratio can be computed with high accuracy.

Moreover, according to the present embodiment, since the specified value "KC" is established according to the initial estimated air-fuel-ratio, the specified value "KC" can be established at an appropriate value. It can be avoided to establish the specified value "KC" at an excessively large value.

Besides, when performing the air-fuel-ratio detection timing determination, the variation in cylinder-by-cylinder correction quantity is restricted. Thus, it can be avoided that the deviation of the air-fuel detection timing is erroneously detected. Further, when the observation residual "err" is less than the specified threshold value, the initial estimated air-fuel-ratio is computed, whereby the computation accuracy of the initial estimated air-fuel-ratio can be improved.

Moreover, when the observation residual "err" is greater than or equal to the threshold value, the Kalman gain "K" is set to the high gain "Khigh". When the observation residual "err" is smaller than the threshold value, the Kalman gain "K" is set to the low gain "Klow". Thus, in a case that the observation residual "err" is relatively large, great, the Kalman gain "K" is set to the high gain "Khigh" so that the estimated air-fuel-ratio can be converged promptly. Thereby, the observation residual "err" is promptly made smaller and the air-fuel-ratio detection timing determination can be permitted. An executing frequency of the air-fuel-ratio detection timing determination can be made higher. On the other hand, when the observation residual "err" is relatively small, the Kalman gain "K" is set to the low gain "Klow", whereby a noise resistance can be improved.

The initial estimated air-fuel-ratio may be computed based on the estimated air-fuel-ratio immediately after the cylinder-by-cylinder air-fuel-ratio control is started. In this case, a variation amount of the correction quantity may be restricted until the computation of the initial estimated air-fuel-ratio is completed.

The method for correcting the air-fuel-ratio detection timing may be changed suitably. The present disclosure can be applied to an engine having four cylinders and an engine having two, three, five or more cylinders.

The present disclosure is not limited to an intake port injection engine. The present disclosure can be applied to a direct injection engine or a dual injection engine.

What is claimed is:

1. A cylinder-by-cylinder air-fuel-ratio controller for an internal combustion engine, comprising:

an air-fuel-ratio sensor detecting an air-fuel-ratio of an exhaust gas at a confluent portion into which the exhaust gas flows from each of multiple cylinders of the internal combustion engine;

an estimation portion executing an air-fuel-ratio estimation for estimating the air-fuel-ratio of each cylinder based on a detection value which the air-fuel-ratio sensor detects at an air-fuel-ratio detection timing for each cylinder;

a control portion executing a cylinder-by-cylinder air-fuel-ratio control in which the air-fuel-ratio of each cylinder is controlled based on the estimated air-fuel-ratio of each cylinder;

a determining portion determining whether a deviation in the air-fuel-ratio detection timing exists based on the estimated air-fuel-ratio while the cylinder-by-cylinder air-fuel-ratio control is executed;

a correcting portion correcting the air-fuel-ratio detection timing when the determining portion determines that the deviation in the air-fuel-ratio detection timing exists;

a residual computing portion computing an observation residual based on the detection value of the air-fuel-ratio sensor and the estimated air-fuel-ratio; and a determination prohibiting portion prohibiting the determining portion from determining whether the deviation in the air-fuel-ratio detection timing exists when the observation residual is greater than or equal to a specified threshold value.

2. A cylinder-by-cylinder air-fuel-ratio controller for an internal combustion engine according to claim 1, further comprising:

a control prohibiting portion prohibiting the control portion from executing a cylinder-by-cylinder air-fuel-ratio control when the observation residual is greater than or equal to the specified threshold value.

3. A cylinder-by-cylinder air-fuel-ratio controller for an internal combustion engine according to claim 1, wherein the residual computing portion normalizes the observation residual by means of an amplitude of the detection value which the air-fuel-ratio sensor detects when the residual computing portion computes the observation residual.

4. A cylinder-by-cylinder air-fuel-ratio controller for an internal combustion engine according to claim 1, further comprising:

an initial-value computing portion computing an initial estimated air-fuel-ratio based on the estimated air-fuel-ratio immediately before or after executing the cylinder-by-cylinder air-fuel-ratio control, wherein the determining portion determines that the deviation in the air-fuel-ratio detection timing exists in a case that the estimated air-fuel-ratio becomes larger than the initial estimated air-fuel-ratio when a correction quantity for each cylinder by the cylinder-by-cylinder air-fuel-ratio control exceeds a specified value.

5. A cylinder-by-cylinder air-fuel-ratio controller for an internal combustion engine according to claim 4, wherein the initial-value computing portion prohibits the control portion from executing the cylinder-by-cylinder air-fuel-ratio control or restricts a variation of the correction quantity for each cylinder until a computation of the initial estimated air-fuel-ratio is completed.

6. A cylinder-by-cylinder air-fuel-ratio controller for an internal combustion engine according to claim 4, wherein the determining portion establishes the specified value according to the initial estimated air-fuel-ratio.

7. A cylinder-by-cylinder air-fuel-ratio controller for an internal combustion engine according to claim 4, wherein the determining portion restricts a variation of the correction quantity for each cylinder when executing the air-fuel-ratio detection timing determination.

8. A cylinder-by-cylinder air-fuel-ratio controller for an internal combustion engine according to claim 4, wherein the initial-value computing portion computes the initial estimated air-fuel-ratio when the observation residual is less than the specified threshold value.

9. A cylinder-by-cylinder air-fuel-ratio controller for an internal combustion engine according to claim 1, further comprising:

a gain-switching portion setting a gain of the air-fuel-ratio estimation to a high gain when the observation residual is greater than or equal to the specified threshold value, the gain-switching portion setting the gain of the air-fuel-ratio estimation to a low gain when the observation residual is less than the specified threshold value.

* * * * *